US006343577B2

(12) United States Patent
Toriumi

(10) Patent No.: US 6,343,577 B2
(45) Date of Patent: Feb. 5, 2002

(54) APPARATUS AND METHOD FOR CONTROLLING POSITION OF ELECTROMAGNETICALLY OPERATED ENGINE VALVE OF INTERNAL COMBUSTION ENGINE

(75) Inventor: Masaki Toriumi, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/764,071

(22) Filed: Jan. 19, 2001

(30) Foreign Application Priority Data

Jan. 21, 2000 (JP) ..... 12-013223

(51) Int. Cl.[7] ..... F01L 9/04
(52) U.S. Cl. ..... 123/90.11; 73/117.2
(58) Field of Search ..... 123/90.11; 251/129.01, 251/129.1, 129.15, 129.16; 73/117.2, 117.3

(56) References Cited

U.S. PATENT DOCUMENTS 4,984,541 A * 1/1991 Kawamura ..... 123/90.11
5,596,956 A * 1/1997 Ogawa et al. ..... 123/90.11
5,752,478 A * 5/1998 Sono et al. ..... 123/90.11
6,158,403 A * 12/2000 Berecewicz et al. ..... 123/90.11

FOREIGN PATENT DOCUMENTS

JP 11-81940 3/1999

* cited by examiner

*Primary Examiner*—Weilun Lo
(74) *Attorney, Agent, or Firm*—Foley & Lardner

(57) ABSTRACT

In electromagnetically operated engine valve position controlling apparatus and method, after such an initialization before an engine start as to hold the engine valve (for example, an intake valve) at a closure position (or at a full open position) and hold another engine valve (for example, an exhaust valve) at the full open position (or at the closure position) is carried out, such a correction for an error in an output value of a position sensor to detect a displaced position of an armature with respect to a pair of electromagnets in the electromagnetically operated valve unit due to an aging effect as to correct a relationship of the output value of the position sensor to a normally detected value of the position of the armature is carried out on the basis of; for example, the two different output signal values of the position sensor which corresponds to a closure position of the intake valve and corresponds to the full open position of the exhaust valve. Other embodiments on the correction of relationship of the output value of the position sensor to the detected value of the position of the armature are disclosed.

20 Claims, 19 Drawing Sheets

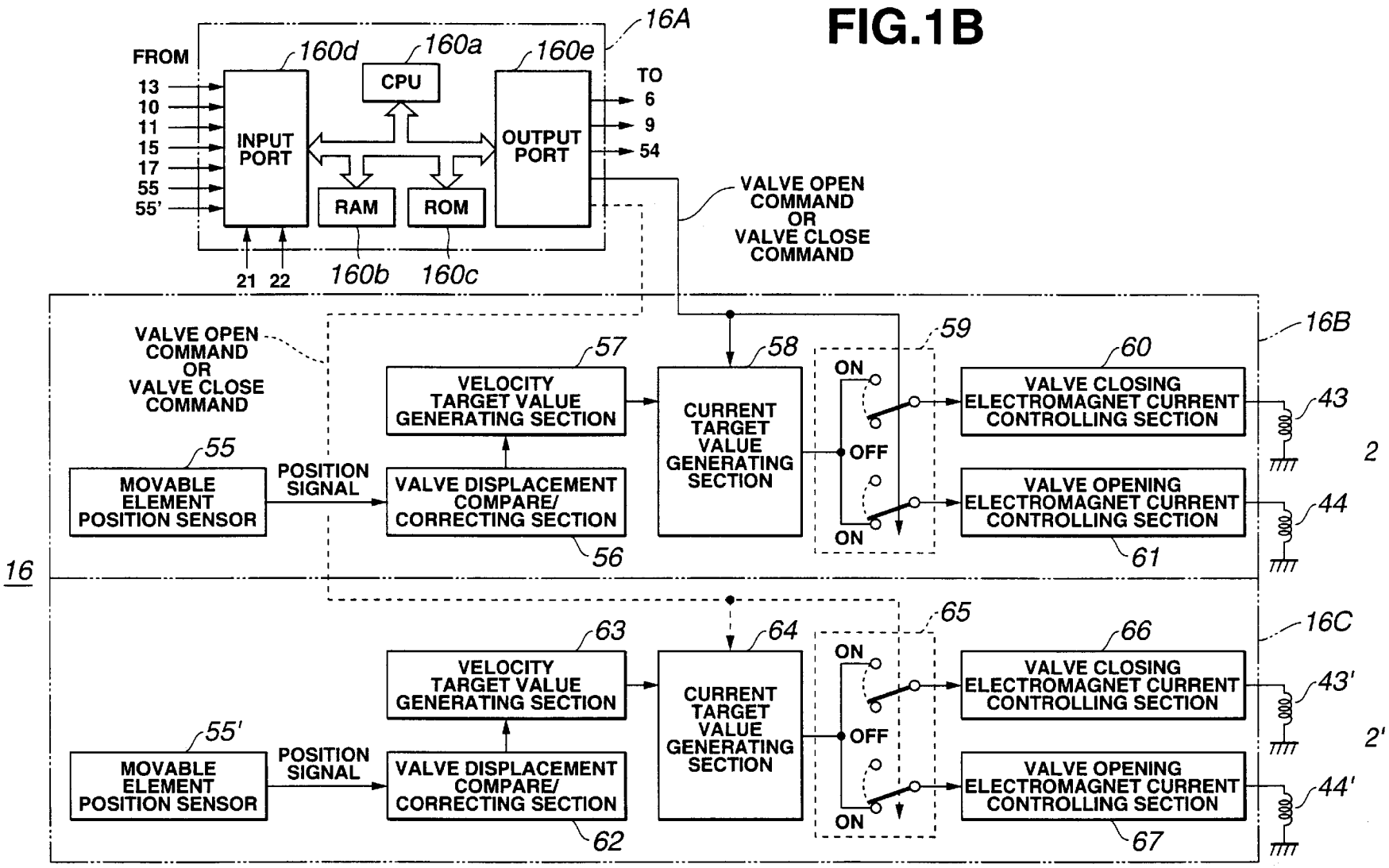
FIG.1B
16A
FROM
13
10
11
15
17
55
55'
INPUT PORT
160d
CPU
160a
RAM
160b
ROM
160c
OUTPUT PORT
160e
TO
6
9
54
21
22
VALVE OPEN COMMAND OR VALVE CLOSE COMMAND
16B
16C
2
2'
43
44
43'
44'
VALVE CLOSING ELECTROMAGNET CURRENT CONTROLLING SECTION
60
VALVE OPENING ELECTROMAGNET CURRENT CONTROLLING SECTION
61
66
67
59
65
ON
OFF
ON
CURRENT TARGET VALUE GENERATING SECTION
58
64
VELOCITY TARGET VALUE GENERATING SECTION
57
63
VALVE DISPLACEMENT COMPARE/ CORRECTING SECTION
56
62
POSITION SIGNAL
MOVABLE ELEMENT POSITION SENSOR
55
55'
16

APPARATUS AND METHOD FOR CONTROLLING POSITION OF ELECTROMAGNETICALLY OPERATED ENGINE VALVE OF INTERNAL COMBUSTION ENGINE

BACKGROUND OF THE INVENTION

1. Field of the Invention

The present invention relates generally to control apparatus and method for controlling a position of an electromagnetically operated engine valve for an internal combustion engine with a position sensor and, particularly, relates to the controlling apparatus and method in which an output value of a position sensor to detect a displaced position of an armature with respect to a pair of electromagnets constituting the electromagnetically operated engine valve is retrieved and corrected during an engine start to eliminate an error in an output value of the position sensor.

2. Description of the Related Art

A Japanese Patent Application First Publication No. Heisei 11-81940 published on Mar. 26, 1999 exemplifies a previously proposed electromagnetically operated engine valve.

In such an electromagnetically operated engine as described above, a biasing force of a pair of springs causes a valve body of an intake or exhaust valve to be supported at a half open position (also called, a neutral position). Then, an electromagnetic force is acted upon an armature associated with the valve body so that the intake or exhaust valve is moved in either a maximum (or full) open direction or a closure direction. In such a kind of electromagnetically operated engine valve as described above, an initialization such that the electromagnetically operated engine valve is held at a full open position or the closure position is carried out before the engine is started. Thereafter, a power supply to a valve closing electromagnet is turned of f when the valve is to be opened. The biasing force of the pair of springs causes the valve body to be moved in the valve open direction. When a valve axle of the engine valve approaches sufficiently to a valve opening electromagnet and the power supply to the valve opening electromagnet is turned on, the armature is attracted onto the valve opening electromagnet and held thereat as the full open position. When the engine valve is to be closed, the power supply to the valve opening electromagnet is turned off and the valve axle (armature) is moved in the closure direction by means of the biasing force of the pair of springs. When the valve body is moved toward the valve closure direction and approaches sufficiently to the valve closing electromagnet, the power supply to the valve closing electromagnet is turned on and the valve body (armature) is attracted onto the valve closing electromagnet and held at the valve closing electromagnet so that the valve is held at the closure direction. Such a valve open-and-closure control for the engine valve as described above is, thus, carried out.

SUMMARY OF THE INVENTION

A control over the power supply turn-on-and-off for the valve opening electromagnet and the valve closing electromagnet is carried out in a feedback control mode such that while a position sensor is detecting a position of the armature, a velocity of the armature is made substantially equal to a target velocity thereof based on the position of the armature.

In the control over the power supply turn-on-and-off of the power supply, a velocity of each of the armature and the valve body to be reached to both of the electromagnets and a valve seat is sufficiently reduced so that a shock is relieved. Furthermore, it is necessary to make the power supply turn on-and-off control highly accurate to secure a response characteristic. To achieve the highly accurate control of the armature position, it is necessary to secure a detection accuracy of the armature position by the position sensor.

However, since the armature position is varied in time due to its aging effect caused by wears in each part of the electromagnetically operated engine valve, the detection accuracy on the armature position is reduced.

It is hence an object of the present invention to provide apparatus and method for controlling a position of electromagnetically operated engine valve in which an output signal value of the position sensor to detect the position of the armature common to the pair of electromagnets is appropriately corrected, consequently, the armature position can always be detected with a high accuracy, and a highly accurate control over the open-and-closure position of the electromagnetically operated engine valve can be achieved.

According to one aspect of the present invention, there is provided a control apparatus for an internal combustion engine, comprising: an armature that is associated with an engine valve; a spring to bias the armature at a neutral position which is located at an intermediate position between an open position of the engine valve and a closure position thereof; a first electromagnet to attract the armature toward the open position; a second electromagnet to attract the armature toward the closure position; a position sensor to detect a position of the armature and output a signal indicative of the position of the armature; and a controller that controls the first and second electromagnets responsive to the output signal of the position sensor so that the engine valve is displaced between the open position and the closure position and that corrects the output signal of the position sensor on the basis of two output signals of the position sensor which correspond to two different positions of the engine valve, one of the two different positions being one of the open position and the closure position upon a completion of an initialization prior to an engine start.

According to another aspect of the present invention, there is provided control method for an internal combustion engine, the internal combustion engine comprising: a spring to bias an engine valve at a neutral position which is located at an intermediate position between a full open position of the engine valve and a closure position thereof; a first electromagnet to attract the engine valve toward the full open position and hold the engine valve thereat when energized; a second electromagnet to attract the engine valve toward the closure position and hold the engine valve thereat when energized; and a position sensor to detect a position of an armature which is common to each of the first and second electromagnets and is associated with a valve body of the engine valve and output a signal indicative of the position of the armature and the control method comprising: executing an initialization prior to an engine start for the engine valve; correcting a relationship of an output signal value of the position sensor to a detected value of the position of the armature on the basis of two output signal values of the position sensor which corresponds to two different positions of the engine valve, one of the two different positions being one of the full open position and the closure position after executing the initialization; and being responsive to the output signal of the position sensor to control a turn on-and-off of a power supply to each of the first and second electromagnets so that the engine valve is displaced between the full open position and the closure position.

This summary of the invention does not necessarily describe all necessary features so that the invention may also be a sub-combination of these described features.

BRIEF DESCRIPTION OF THE DRAWINGS

FIG. 1B is a rough system configuration view of a controller in the first preferred embodiment shown in FIG. 1A.

DETAILED DESCRIPTION OF THE PREFERRED EMBODIMENTS

Reference will hereinafter be made to the drawings in order to facilitate a better understanding of the present invention.

(First Embodiment)

Figure 1A:
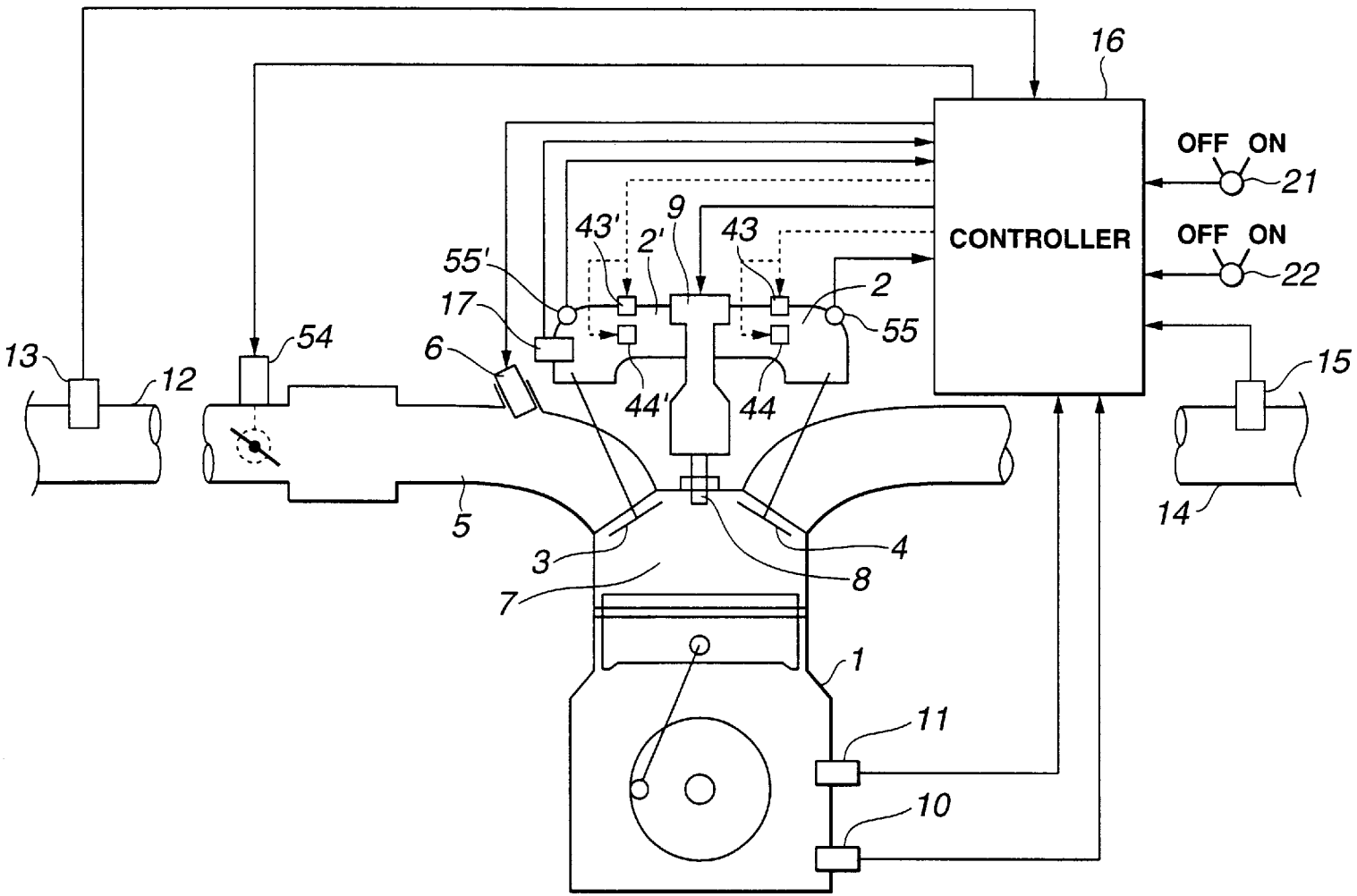
FIG. 1A is a system configuration of an internal combustion engine to which an apparatus for controlling a position of electromagnetically operated position controlling apparatus in a first preferred embodiment according to the present invention is applicable.

FIG. 1A shows an internal combustion engine to which an apparatus for controlling a position of an electromagnetically operated engine valve in a first preferred embodiment according to the present invention is applicable.

In FIG. 1A, an internal combustion engine 1 is provided with an intake valve 3 and an exhaust valve 4. In the first embodiment, the electromagnetically operated engine valve is applied to each of intake valve 3 and exhaust valve 4. Intake valve 3 includes an electromagnetically variable drive unit 2' and exhaust valve 4 includes an electromagnetically variable drive unit 2. A fuel injection valve 6 is equipped within an intake port 5 and a combustion chamber 7 is equipped with a spark plug 8 and an ignition coil 9. A crank angle sensor 10 outputs a reference signal whenever an engine crankshaft revolves through a reference angle for each cylinder and outputs a unit angle signal whenever the engine crankshaft has revolved though a unit angle. An engine coolant temperature sensor 11 to detect an engine coolant temperature is attached onto engine 1. An airflow meter 13 to detect an intake air quantity is installed in an intake air passage 12 located within an upstream portion to intake port 5. An air-fuel ratio sensor 15 is installed within an exhaust passage 14 to detect an air-fuel ratio via a detection of an oxygen concentration in exhaust gas.

In FIG. 1A, a reference numeral 21 denotes an ignition switch to detect whether an ignition switch is turned on or off and a reference numeral 22 denotes a start switch to detect whether an engine start switch is turned on or off.

A controller 16 receives detection signals from various sensors. Controller 16 outputs a fuel injection pulse signal to fuel injection valve 6 for its corresponding cylinder to perform the fuel injection control (viz., start timing and fuel injection quantity) on the basis of the detection signals from various sensors and outputs an ignition signal to each ignition coil 9 to perform an ignition timing control on the basis of the detection signals from the various sensors. Controller 16 further outputs valve drive signals to electromagnetically variable drive units 2 and 2' to control open-and-closure control for intake valve 3 and exhaust valve 4 on the basis of the detection signals of the sensors.

FIG. 1B shows a rough configuration view of controller 16 and its peripheral circuit including the electromagnetically operated engine valve in the first embodiment.

Figure 2:
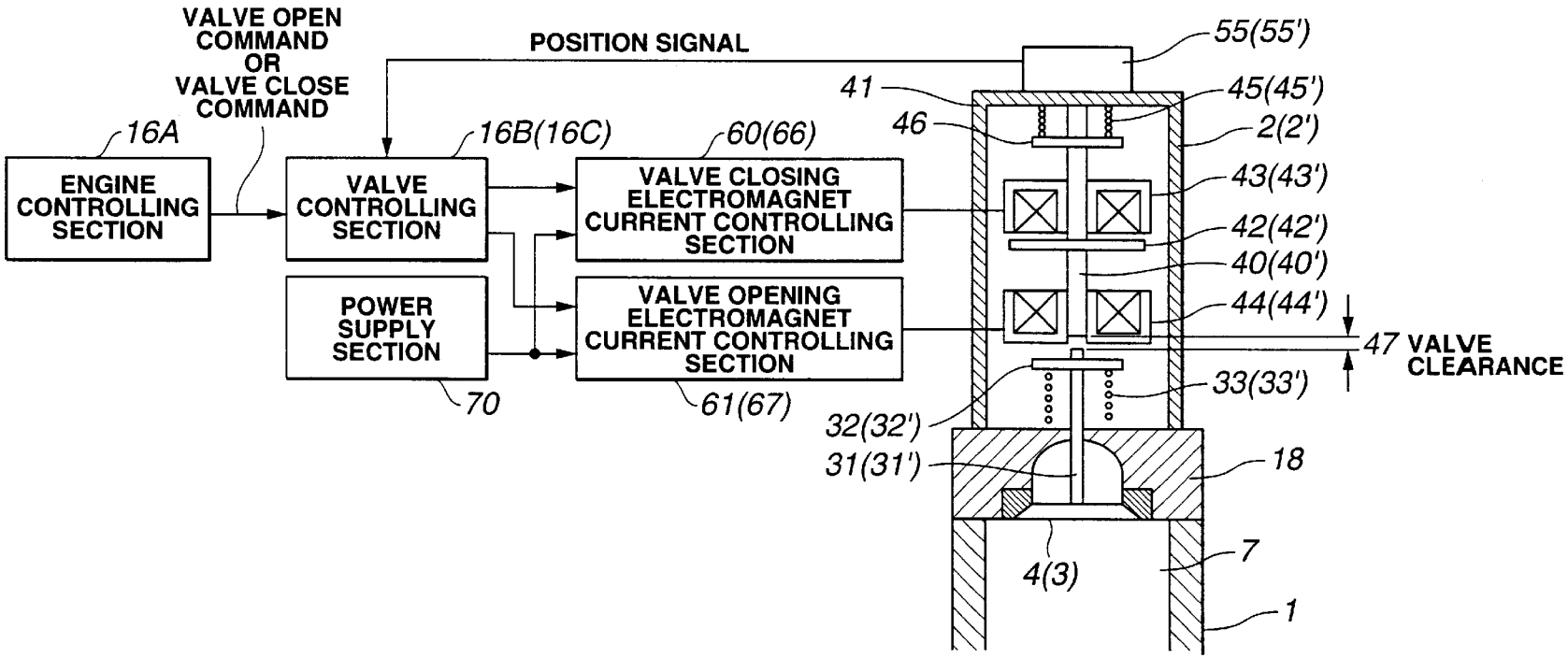
FIG. 2 is a rough functional block diagram of the electromagnetically operated engine valve position controlling apparatus in the first preferred embodiment shown in FIG. 1A.

FIG. 2 shows a functional block diagram of an electromagnetic valve position control apparatus according to the present invention in the first preferred embodiment.

In FIG. 1B, controller 16 includes an engine control block 16A and electromagnetically operated engine valve control blocks 16B and 16C.

Engine control block 16A includes a microcomputer having a CPU (Central Processing Unit) 160*a*, a RAM (Random Access Memory) 160*b*; a ROM (Read Only Memory) 160*c*; an Input Port 160*d*; an Output Port 160*e*; and common bus.

It is noted that although intake and exhaust valve control blocks 16B and 16C shown in FIG. 1B are described functionally, parts of each block 16B and 16C are constituted by the microcomputer described above. It is also noted that these blocks 16B and 16C are for a typical engine cylinder but the same blocks are applied to each of the engine cylinders.

Exhaust (intake) valve control block 16B (16C) includes a movable element position sensor 55 (55') (hereinafter, referred simply to as a position sensor) which outputs a signal indicative of a position of an armature 42 (42') constituting a movable element of exhaust (intake) valve 4 (3) to a valve displacement compare/correcting section 56 (62) to correct a relationship between an output signal value of position sensor 55 (55') and a detected value of position of armature 42 (42') (actual position value of armature 42') as will be described later. The corrected position signal is supplied to a velocity target value generating section 57 (63). Velocity target value generating section 57 (63) generates a target value of a velocity of the valve body (valve stem 31 (31')) of exhaust (intake) valve 4 (3), i.e., the valve displacement position of exhaust (intake) valve 4 (3). The target value of the velocity of exhaust (intake) valve 4 (3) is supplied to a current target value generating section 58 (64). Current target value generating section 58 (64) generates a target value of an electric current flowing through either a valve opening electromagnet 43 (43') or a valve closing electromagnet 44 (44') in response to a valve open command or a valve close command from engine controlling block 16A on the basis of the target value of the velocity of valve at velocity target value generating section 57 (63). A switching section 59 (65) switches to connect current target value generating section 58 (64) to either a valve closing electromagnet current controlling section 60 (66) or a valve opening electromagnet current controlling section 61 (67), in response to the valve close command or the valve open command. Valve closing or opening electromagnet current controlling section 60 or 61 (66 or 67) is connected to either valve closing electromagnet 43 (43') or valve opening electromagnet 44 (44') in response to the active valve close command or the active valve open command.

It is noted that, in FIG. 2, valve closing electromagnet current controlling section 60 and valve opening electromagnet current controlling section 61 are replaced with the same sections 66 and 67 in the case of intake valve 3 and a power supply section 70 includes a vehicular battery and a power supply booster.

Figure 3A:
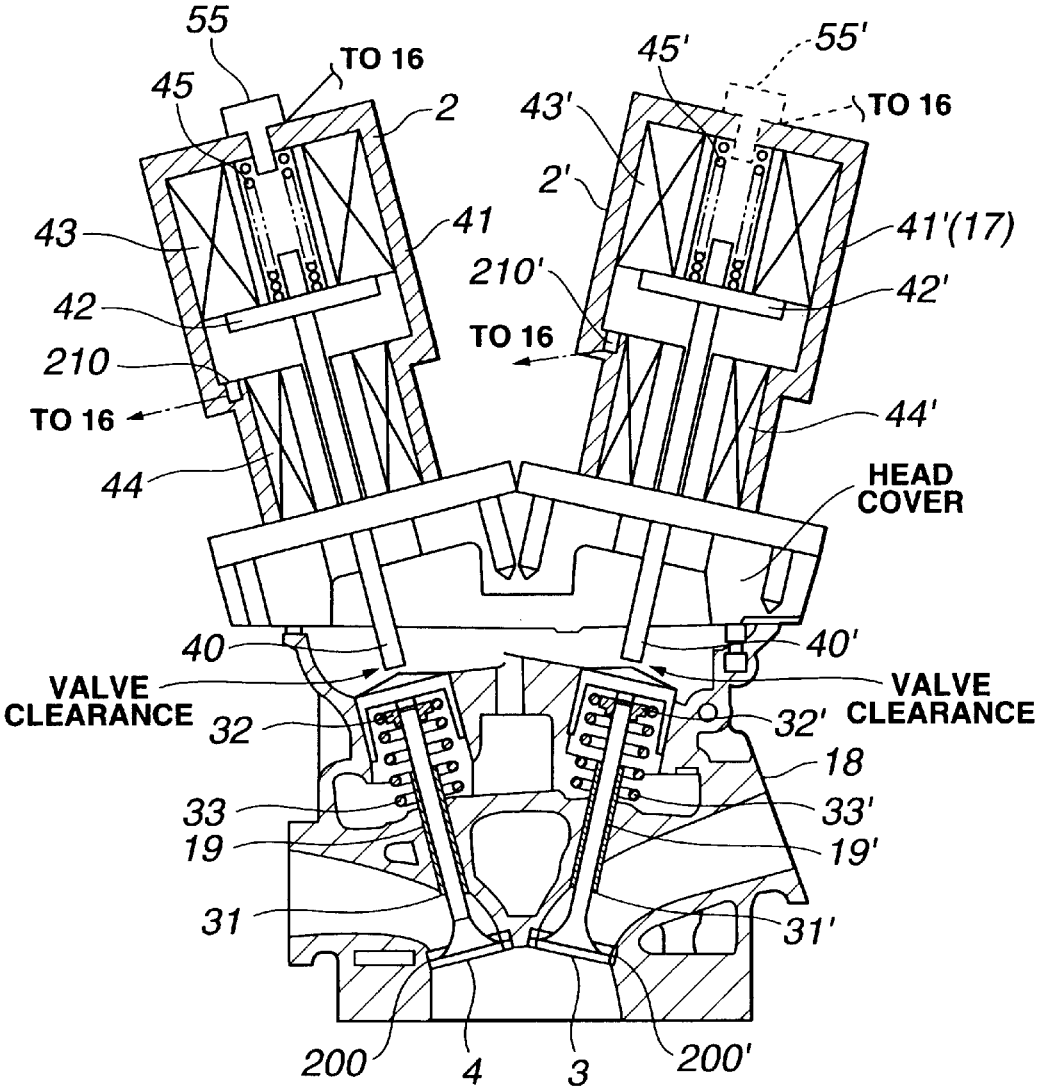
FIG. 3A is a cross sectional view of electromagnetically operated intake and exhaust valves of the internal combustion engine shown in FIG. 1A for explaining a closure position of an engine valve.
Figure 3B:
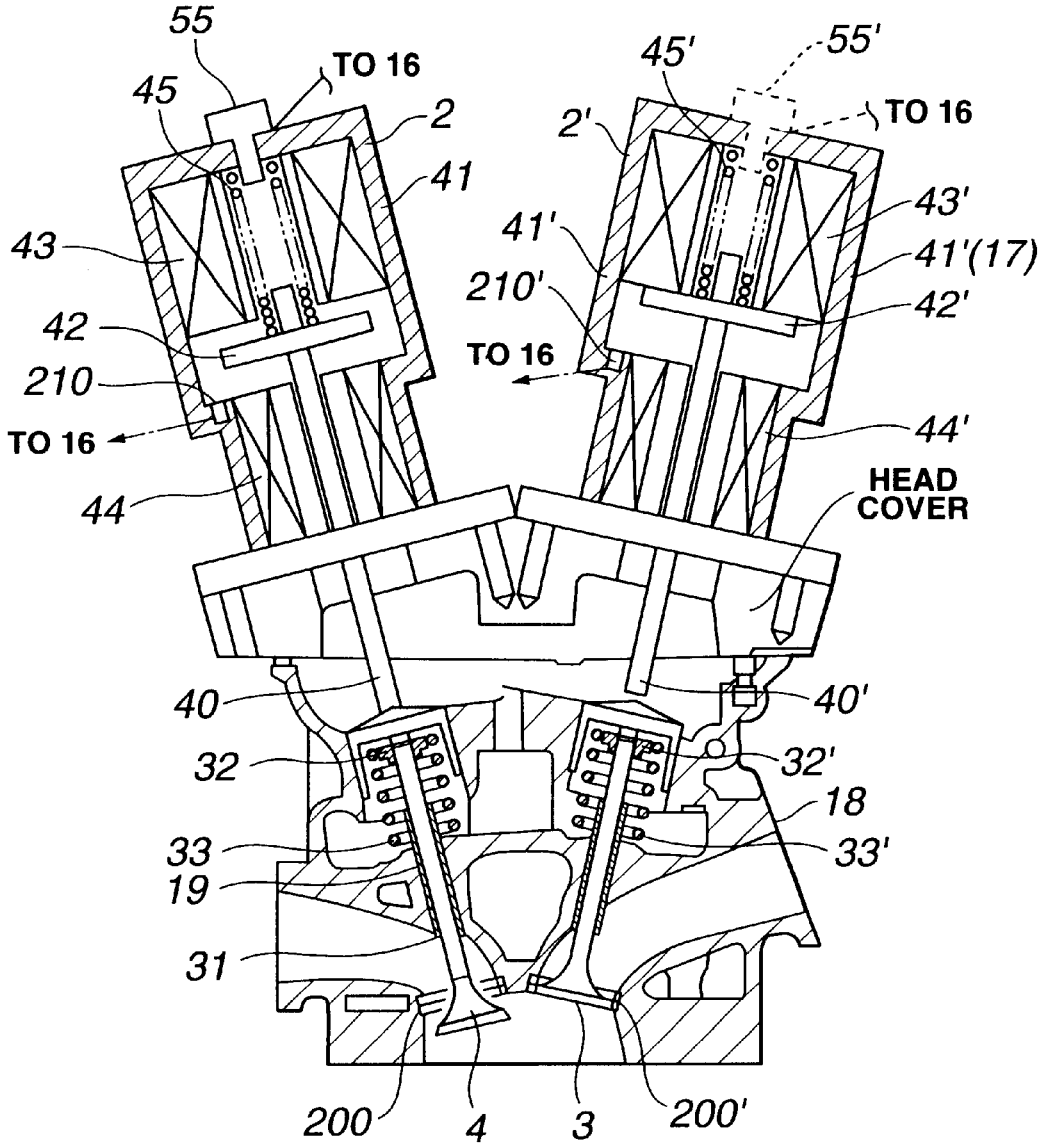
FIG. 3B is a cross sectional view of the electromagnetically operated intake and exhaust valves of the engine shown in FIG. 1A for explaining a neutral position (initial position or half open position) of the engine valve.
Figure 3C:
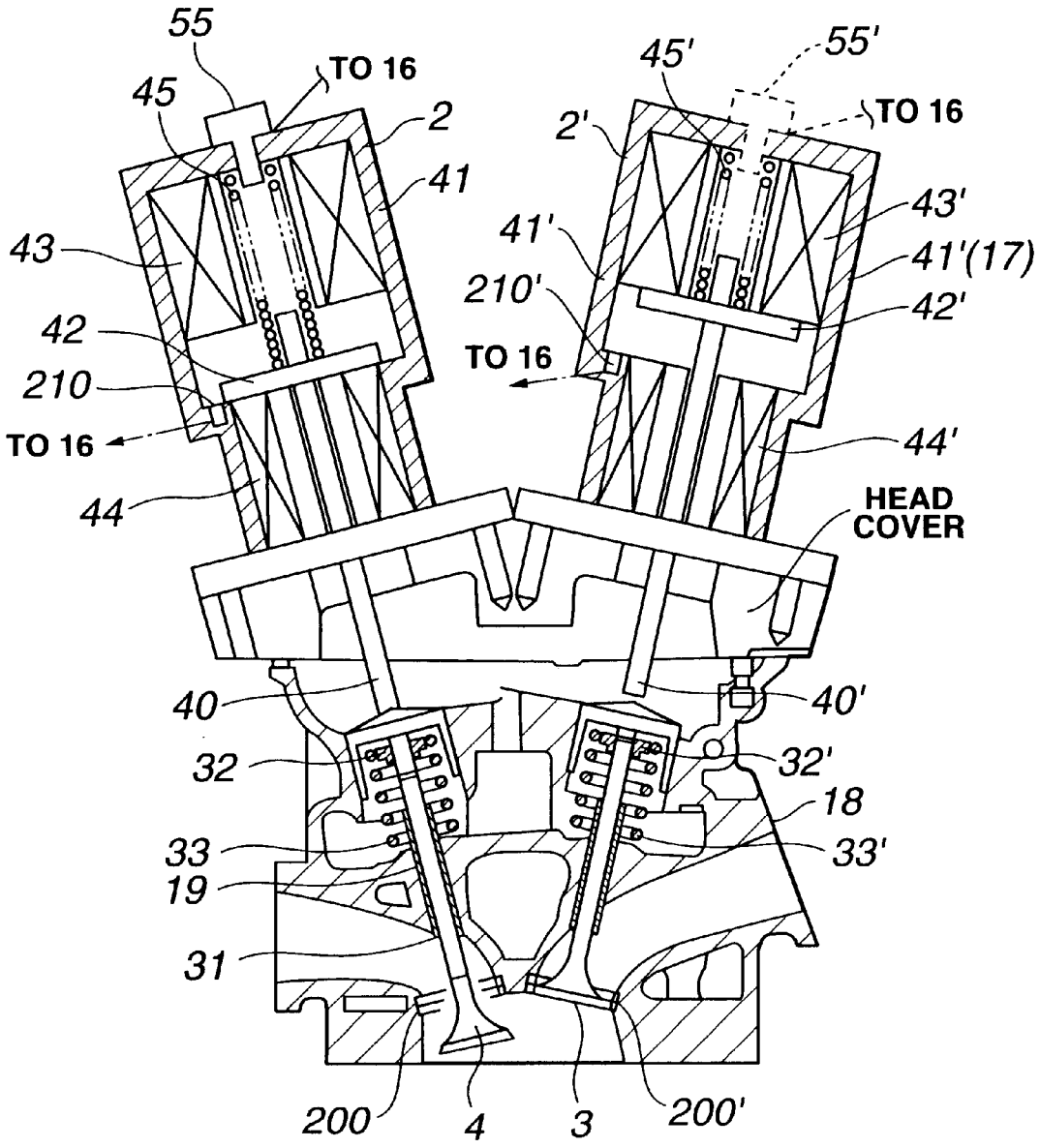
FIG. 3C is a cross sectional view of the electromagnetically operated intake and exhaust valves of the engine shown in FIG. 1A for explaining a full open position of the engine valve.

FIGS. 3A, 3B, and 3C show cross sectional views of electromagnetically operated intake and exhaust valves 3 and 4 for explaining a closure position, a neutral position (half open position), and a full open position of the electromagnetically operated engine valve to which the electromagnetically operated engine valve position controlling apparatus in the first embodiment according to the present invention is applicable .

In FIG. 3A, exhaust (intake) valve 4 (3) is attached conventionally onto a cylinder head 18. The valve stem 31 (31') of exhaust (intake) valve 4 (3) is slidably inserted along a valve guide 19 (19'). An upper seat 32 (32') is attached onto an upper completion of valve stem 31 (31') via a valve cotter. A valve closing spring 33 (33') (compressed by a predetermined compression distance from a free length) is interposed between upper seat 32 (32') and the lower seat provided at the cylinder head to bias exhaust (intake) valve 4 (3) in a valve closure direction.

Then, with exhaust (intake) valve 4 (3) closed and armature 42 (42') magnetically attracted onto valve closing electromagnet 43 (43'), a movable axle 40 (40') of valve drive unit 2 (2') is coaxially disposed on the same axle as valve stem 31(31') with a predetermined valve clearance, viz., with a predetermined space apart from an upper end of valve stem 31 (31').

The valve drive unit 2 (2') includes: a housing 41 (41') made of a non-electromagnetic material; armature (armature plate) 42 (42') integrally attached onto movable axle 40 (40') slidably attached within housing 41 (41'); a valve closing spring 33 (33') to bias exhaust (intake) valve 4 (3) in the valve closure direction which is disposed between upper seat 32 (32') and the lower seat at cylinder head 18; valve closing electromagnet 43 (43') fixed within housing 41 (41') at a position facing toward an upper surface of armature 42 (42') so as to enable a magnetic attraction of armature 42 (42'); valve opening electromagnet 44 (44') fixed within housing 41 (41') at a position facing toward a lower surface of armature 42 (42') so as to enable a magnetic attraction of armature 42 (42'); and a valve opening spring 45 (45') which biases armature 42 (42') in the valve opening direction of exhaust (intake) valve 4 (3).

As shown in FIG. 3B, when both of valve closing electromagnet 43 and valve opening electromagnet 44 are de-energized, exhaust valve 4 is so structured as to be at the half open position (also called, the neutral position) due to only the spring force exerted by the pair of springs 45 and 33.

Referring back to FIG. 3A, when the power supply to valve closing electromagnet 43 is turned on to energize only valve closing electromagnet 43, armature 42 is magnetically attracted toward valve closing electromagnet 43 in the direction to which valve opening spring 45 is compressed.

On the other hand, as shown in FIG. 3C, when only valve opening electromagnet 44 is energized with exhaust valve 4 held at the half open position, armature 42 causes valve closing spring 33 to be compressed so as to be magnetically attracted toward valve opening electromagnet 44 to displace exhaust valve 4 at the full open position.

Although the full position, the neutral position, and the closure position of exhaust valve 4 has been explained with reference to FIGS. 3A through 3C, these positions can be applied to a case of intake valve 3.

As shown in FIGS. 3A through 3C, position sensor 55 (55') to detect a position of armature 42 (42') is attached on an uppermost housing wall of valve drive unit 2 (2'). The position sensor 55 (55') is constituted by, for example, an eddy current sensor or a Hall Effect device. While position sensor 55 (55') detects position of the armature 42 (42'), the power supply control between the valve closing electromagnet 43 (43') and valve opening electromagnet 44 (44') is carried out in such a manner that armature 42 (42') is driven with characteristics each having the target value of the velocity for a corresponding position of armature 42 (42').

This can achieve the following feedback control advantages. The armature 42 (42') is driven at a relatively high velocity from a time at which armature 42 (42') is separated from one electromagnet and is displaced toward the other electromagnet to secure the response characteristic.

Then, when armature 42 (42') approaches to the other electromagnet, armature 42 (42') is seated on the electromagnet at a sufficiently low velocity to relieve a shock which occurs during the seat of armature 42 (42') on one of the electromagnets. Or the shock can be prevented from occurring when armature 42 (42') stops at a position immediately before the seat on the other of the electromagnets.

The valve open-and-closure operation for the exhaust valve 4 has been described. The same operation as described above is applicable to intake valve 3. It is noted that FIG. 3A shows the state of the electromagnetically operated engine valve in the closure position, FIG. 3B shows the state thereof in the neutral position, and FIG. 3C shows the state thereof in the full open position. It is also noted that recesses 210 and 210' are provided for collecting wires of the electromagnets in respective housings 41 and 41' and reference numerals 200 and 200' denote valve seats.

Figure 4:
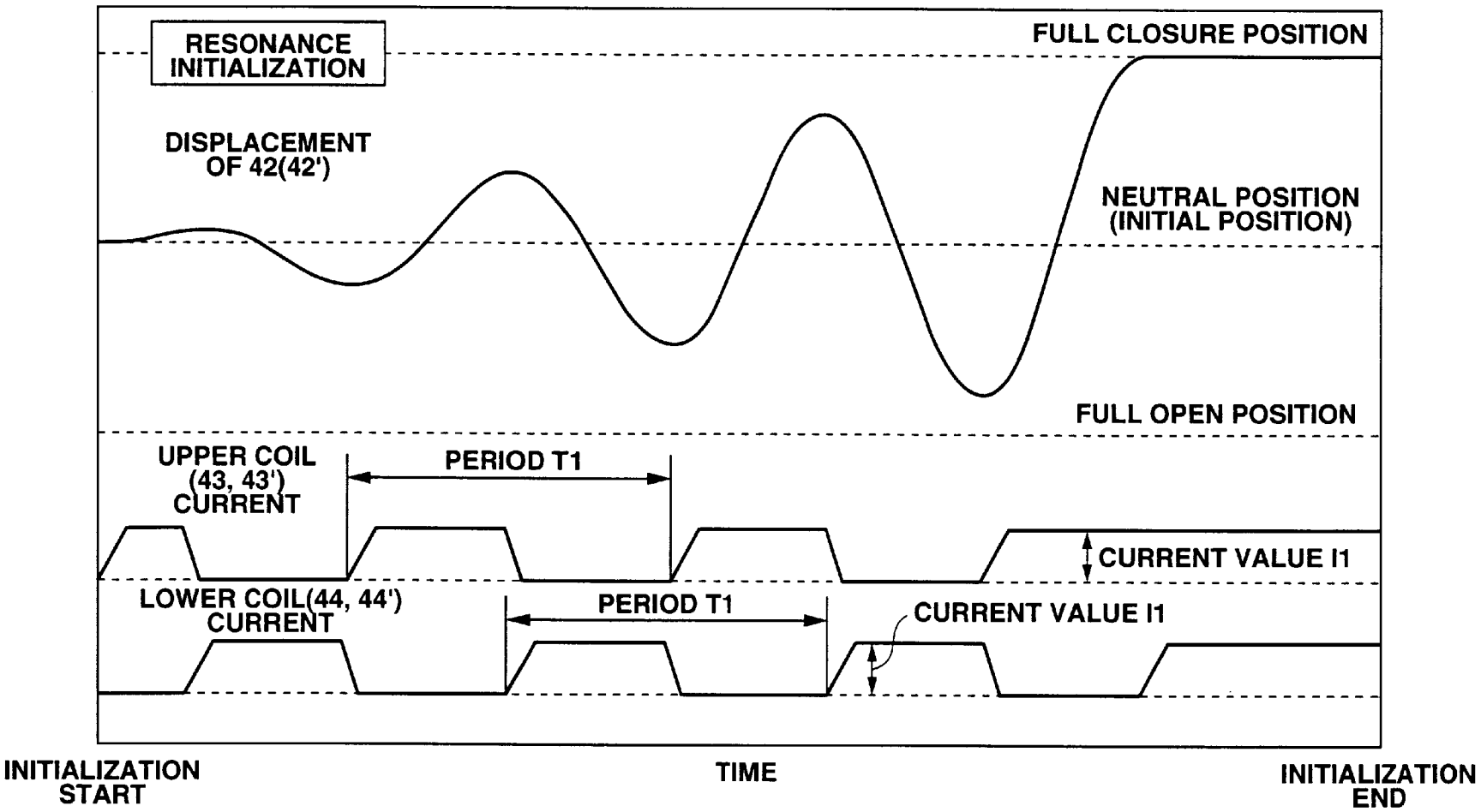
FIG. 4 is a timing chart of a resonance initialization of the electromagnetically operated engine valve for explaining the resonance initialization applicable to the first preferred embodiment shown in FIG. 1A.

Before the engine start, the initialization such that intake valve 3 or exhaust valve 4 is held from the half-open position to the full open position or the full closure position is carried out. The initialization is the alternating supply of power from valve opening electromagnet 44 (44') to valve closing electromagnet 43 (43') and the action of pair of springs 33 (33') and 45 (45') causes the resonance phenomenon to augment the amplitude of supplied currents to the electromagnets and, thereafter, intake (exhaust) valve 3(4) is held at the full open position or at the closure position (refer to FIG. 4).

Immediately after the initialization, controller 16 performs the correction of the detected value of position sensor 55 (55'), namely, the valve displacement compare/correcting block 56 (62) performs a correction of a relationship between the output signal value (voltage) of position sensor 55 (55') for exhaust (intake) valve 4 (3) and the detected value of the armature displaced position (an actual value of the displaced position of armature 42 (42')) (hereinafter, simply called a correction of the detected value of position sensor 55 (55')).

Next, the correction of the detected value of position sensor 55 (55') carried out in the first embodiment will be described below.

Since, in the first embodiment, to perform a cranking after the initialization the open-and-closure position of intake valve 3 after the initialization is set to be different from that of exhaust valve 4, the correction of the detected value of position sensor 55 for exhaust valve 4 is carried out on the basis of the output value of position sensor 55 which corresponds to the closure position of exhaust valve 4 upon a completion of initialization and that of position sensor 55' for the intake valve 3 which corresponds to the full open position of intake valve 3 upon the completion of initialization. Alternatively, the correction of the detected value of position sensor 55 for exhaust valve 4 may be carried out on the basis of the output value of position sensor 55 which corresponds to the full open position of exhaust valve 4 upon the completion of initialization and corresponds to the signal output value of the position sensor 55' which corresponds to the closure position of intake valve 3 upon the completion of initialization. Furthermore, the correction of the detected value of position sensor 55' is carried out on the basis of the output value of position sensor 55' which corresponds to the full open position of intake valve 3 upon the completion of initialization and that of position sensor 55 which corresponds to the full closure position of exhaust valve 4 upon the completion of initialization.

Therefore, the correction method for exhaust valve 4 is two combinations and that for intake valve 3 is two combinations.

Figure 5:
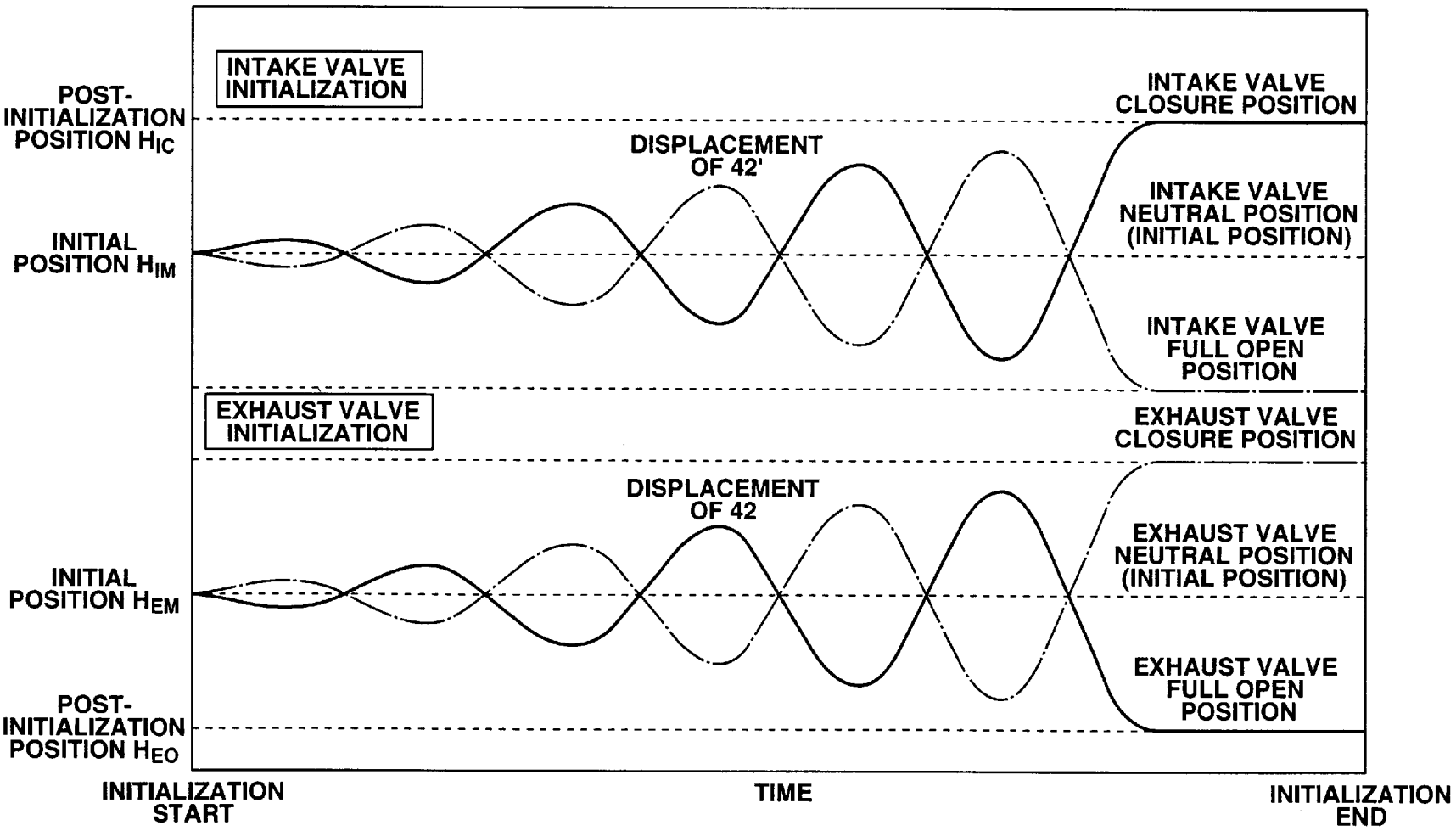
FIG. 5 is a timing chart representing patterns of armature displacements when the intake valve and exhaust valve are initialized with a resonance at mutually different open-and-closure positions in the first embodiment shown in FIG. 1A.

FIG. 5 shows patterns of the initializations for intake and exhaust valves 3 and 4 in the case of the first embodiment.

As shown in FIG. 5, intake valve 3 upon the completion of initialization is held at valve closure position $H_{IC}$ as denoted by a solid line of FIG. 5. Exhaust valve 4 upon the completion of initialization is held at the full open position $H_{EO}$ as denoted by the solid line. It is noted that, as denoted by a dot-and-dash line of FIG. 4, intake valve 3 may be held at the full open position upon the completion of initialization and exhaust valve 4 may be held at the full closure position.

In either case, the positions of intake valve 3 and exhaust valve 4 are different from each other upon the completion of the initialization described above with reference to FIG. 4.

Figure 6:
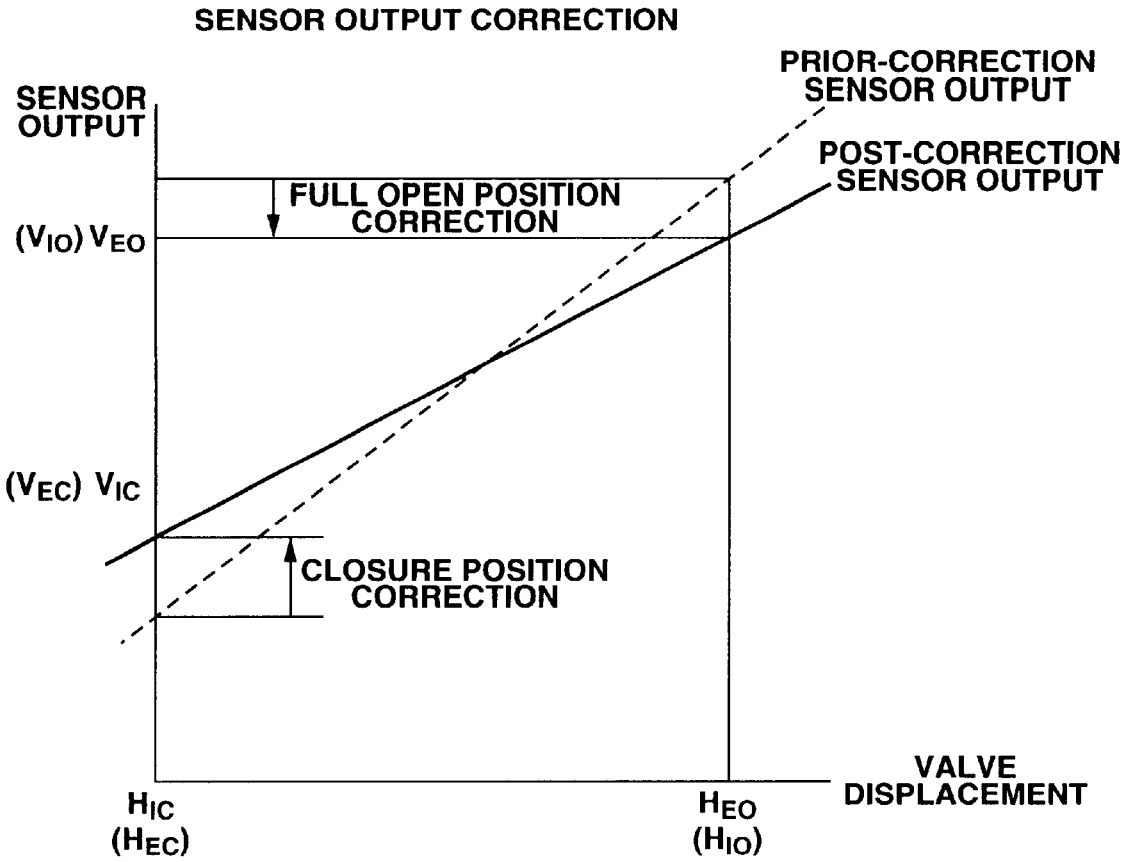
FIG. 6 is a graph representing a pattern of a correction of a detected value of a position sensor of the electromagnetically operated engine valve position controlling apparatus in the first embodiment shown in FIG. 1A according to the present invention.

FIG. 6 shows patterns of the correction of the detected value of position sensor 55 (55') in the first embodiment.

The correction of the detected value of position sensor 55 (55') for exhaust (intake) valve 4 (3) is carried out as a characteristic connecting the output signal value $V_{IC}$ of position sensor 55' which corresponds to the closure position $H_{IC}$ of intake valve 3 upon the completion of the initialization to the output signal value $V_{EO}$ of position sensor 55 which corresponds to the full open position $H_{EO}$ of exhaust valve 4 thereupon by a straight line. Consequently, both of a full open position correction and a closure position correction are carried out as denoted by arrows shown in FIG. 6 for the sensor output before the correction as denoted by a dot line and the valve displacement (armature). An intermediate opening position (between the full open position and the closure position) is accordingly corrected.

It is noted that the correction of the detected value of position sensor 55 (55') for exhaust (intake) valve 4 (3) may be carried out as the characteristic connecting the output signal value $V_{EC}$ of position sensor 55 which corresponds to the closure position of exhaust valve 4 upon the completion of the initialization to the output signal value $V_{IO}$ of position sensor 55' which corresponds to the full open position $H_{IO}$ of intake valve 3 thereupon by the straight line.

It is also noted that the correction for the detected value of position sensors 55 and 55' for exhaust and intake valves 4 and 3 are carried out simultaneously or sequentially upon the completion of the initialization prior to the engine start.

In the first embodiment, with such a normal initialization setting that the open-and-closure position of intake valve 3 is made different from that of exhaust valve 4, a simplest correction can be carried out on the basis of the directly measured output values of position sensors 55 and 55' for exhaust and intake valves 4 and 3. There is a room in improvement in terms of accuracy since a common correction is carried out using the output values of the different position sensors 55 and 55' for the different kinds of engine valves, viz., the exhaust and intake valves 4 and 3.

(Second Embodiment)

Figure 7:
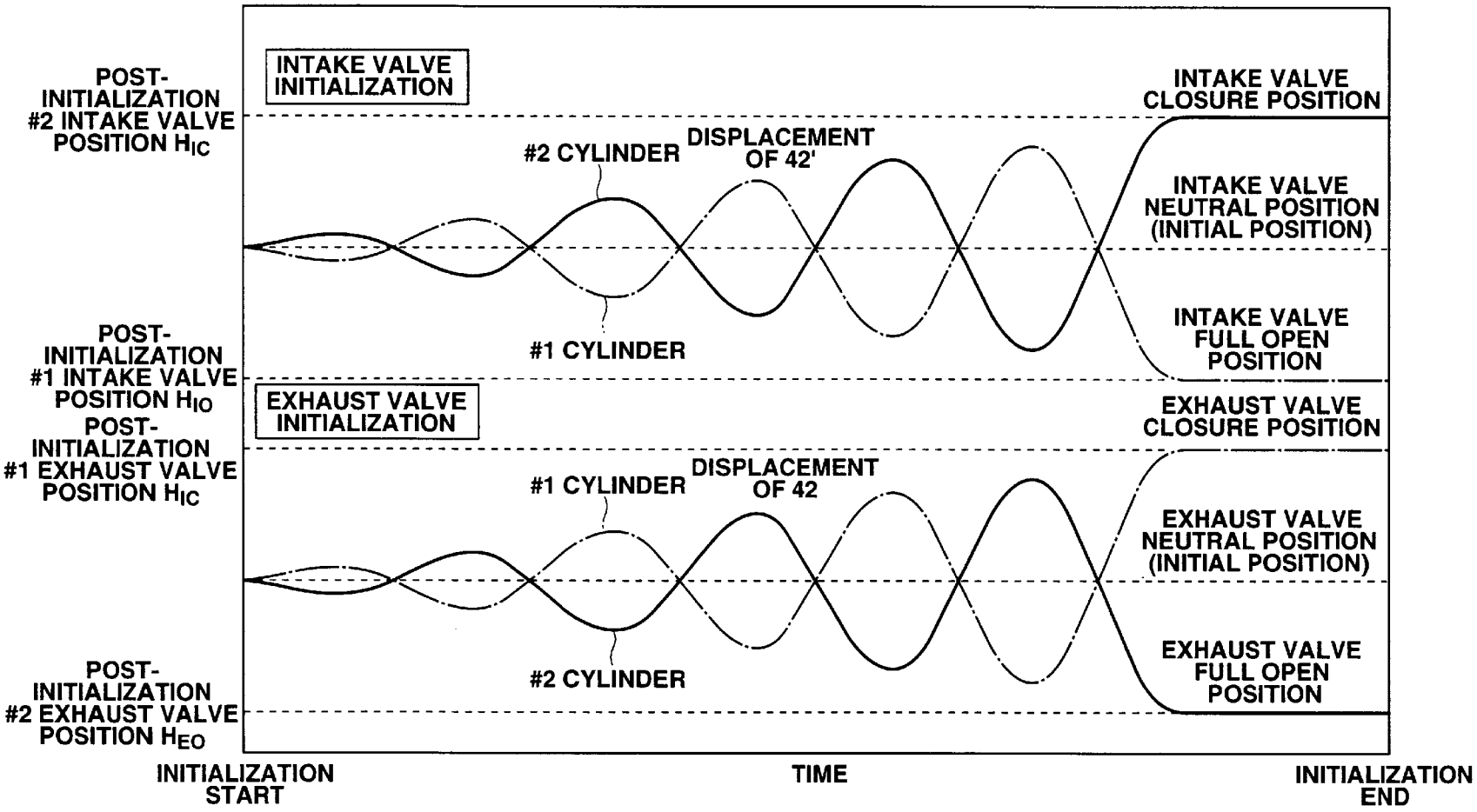
FIG. 7 is a timing chart representing the pattern of the armature displacements (valve displacements) when the intake valve and exhaust valves for respective cylinders are initialized at mutually different open-and-closure positions applicable to a second preferred embodiment of the electromagnetically operated engine valve position controlling apparatus.

FIG. 7 shows an example of the patterns of the initializations carried out in a second preferred embodiment of the electromagnetically operated engine valve position controlling apparatus according to the present invention. The other structure of the second embodiment is generally the same as that of the first embodiment.

In the second embodiment, the open-and-closure position of intake valve 3 upon the completion of initialization is made different from that of exhaust valve 4 thereupon for each cylinder although the correction method becomes complicated in terms of control procedure.

For example, for a first cylinder #1, intake valve 3 is held at the full open position $\#1H_{IO}$ and exhaust valve 4 is held at the closure position $\#1H_{EC}$.

For a second cylinder #2, intake valve 3 is held at the closure position $\#2H_{IC}$ and exhaust valve 4 is held at the full open position $\#2H_{EO}$.

Figure 8:
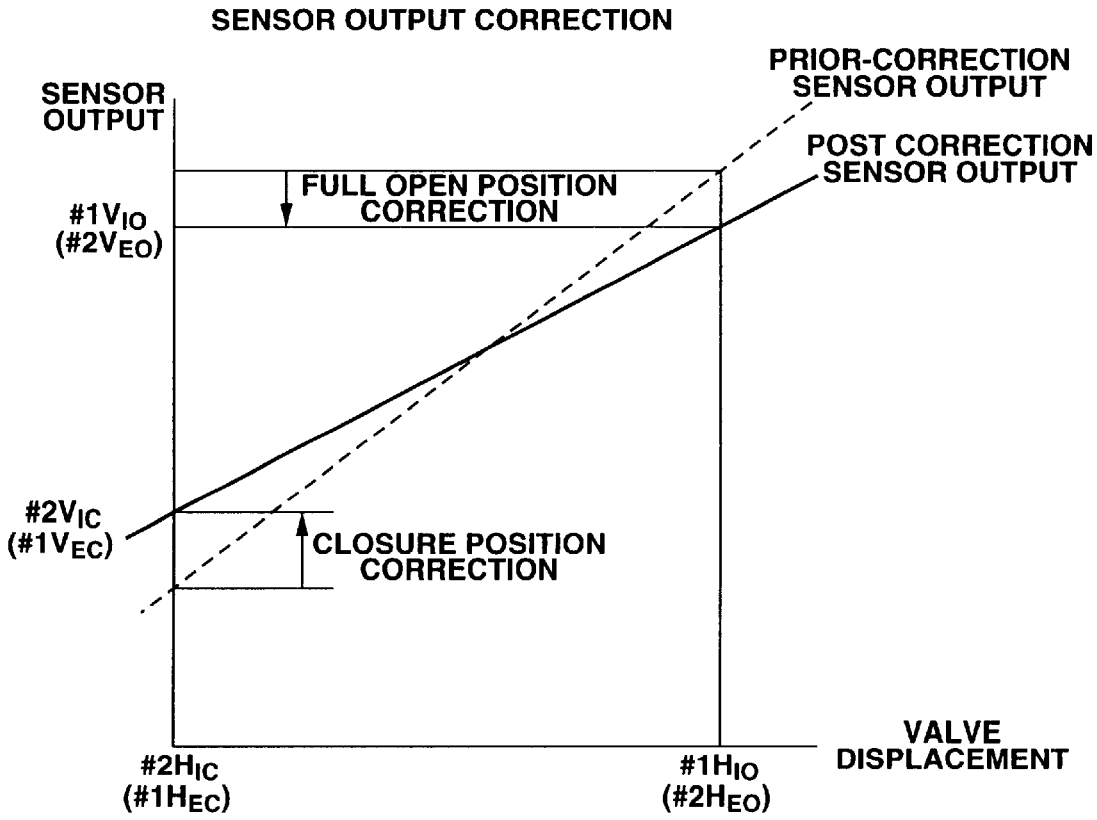
FIG. 8 is a graph representing the pattern of the correction of the detected value of the position sensor in the second embodiment.

Then, the correction of the detected value of the position sensor 55' for intake valve 3 is carried out in the same manner as described in the first embodiment with reference to FIG. 6 on the basis of the output signal value $\#1V_{IO}$ of position sensor 55' which corresponds to the full open position $\#1H_{IO}$ of intake valve 3 of the first cylinder #1 and the output signal value $\#2V_{IC}$ of position sensor 55' which corresponds to the closure position $\#2H_{IC}$ of intake valve 3 of the second cylinder #2 using a table of FIG. 8.

In addition, the correction of the position sensor 55 for exhaust valve 4 is carried out in the same manner as described in the first embodiment with reference to FIG. 6 on the basis of the output signal value $\#1V_{EC}$ of position sensor 55 which corresponds to the closure position $\#1H_{EC}$ of exhaust valve 4 of the first cylinder #1 and the output value $\#2V_{EO}$ of position sensor 55 which correspond to the full open position $\#2H_{EO}$ of exhaust valve 4 of the second cylinder #2. These corrections apply equally well to any other cylinders of the internal combustion engine 1.

FIG. 8 shows the correction pattern for position sensor 55' (55) in the second embodiment as described above.

Since, in the second embodiment, the corrections of the detected values of position sensors 55 (55') for the respective cylinders are carried out on the basis of the output values of position sensors 55 (55') for the same kinds of engine valves, viz., intake valves and exhaust valves 3 and 4 in the respective cylinders, an accuracy of the correction can be improved.

(Third Embodiment)

Next, the correction of the detected value of position sensor 55 (55') carried out in a third preferred embodiment of the electromagnetically operated engine valve position controlling apparatus according to the present invention will be described below.

In the third embodiment, the correction of the detected value of position sensor 55 (55') for each of exhaust and intake valves 4 and 3 is carried out on the basis of the output value of position sensor 55 (55') at the half open position (the neutral position) of the corresponding engine valve before the initialization (or called a prior-initialization) and the output value of position sensor 55 (55') at either the full open position thereof or the closure position thereof upon the completion of the initialization (or called a post-initialization).

The other structure of the electromagnetically operated engine valve position controlling apparatus in the third embodiment is generally the same as described in the first embodiment.

Figure 9:
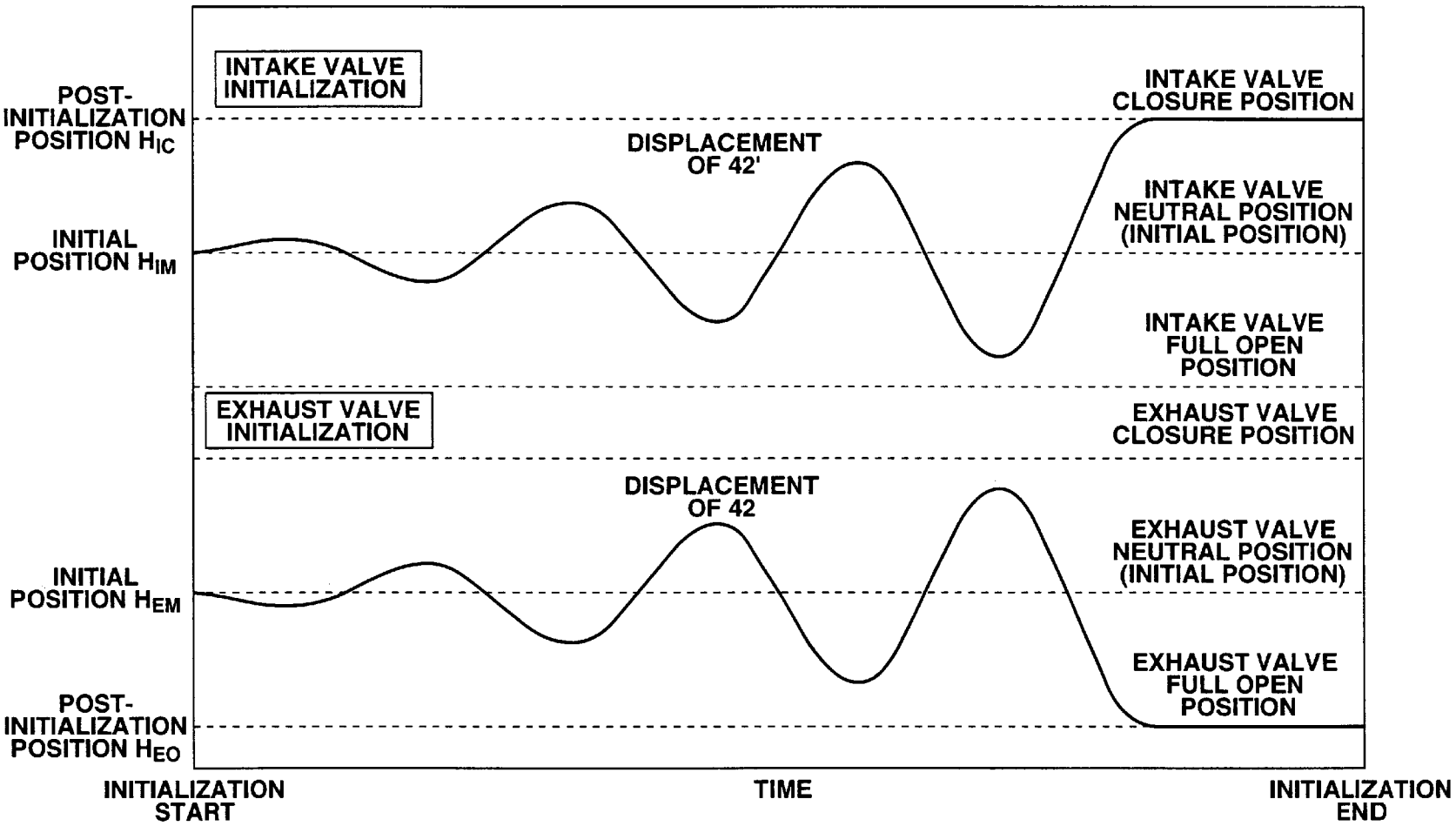
FIG. 9 is a timing chart representing the patterns of the armature displaced position (valve displacement) when the initializations of both intake and exhaust valves are carried out at different open-and-closure positions from those before the initialization applicable to a third preferred embodiment of the electromagnetically operated engine valve position controlling apparatus according to the present invention.

FIG. 9 shows patterns of initialization for intake valve 3 and exhaust valve 4 applicable to the third embodiment in which intake valve 3 is held at the closure position $H_{IC}$ upon the completion of initialization and exhaust valve 4 is held at the full open position $H_{EO}$ thereupon.

Figure 10:
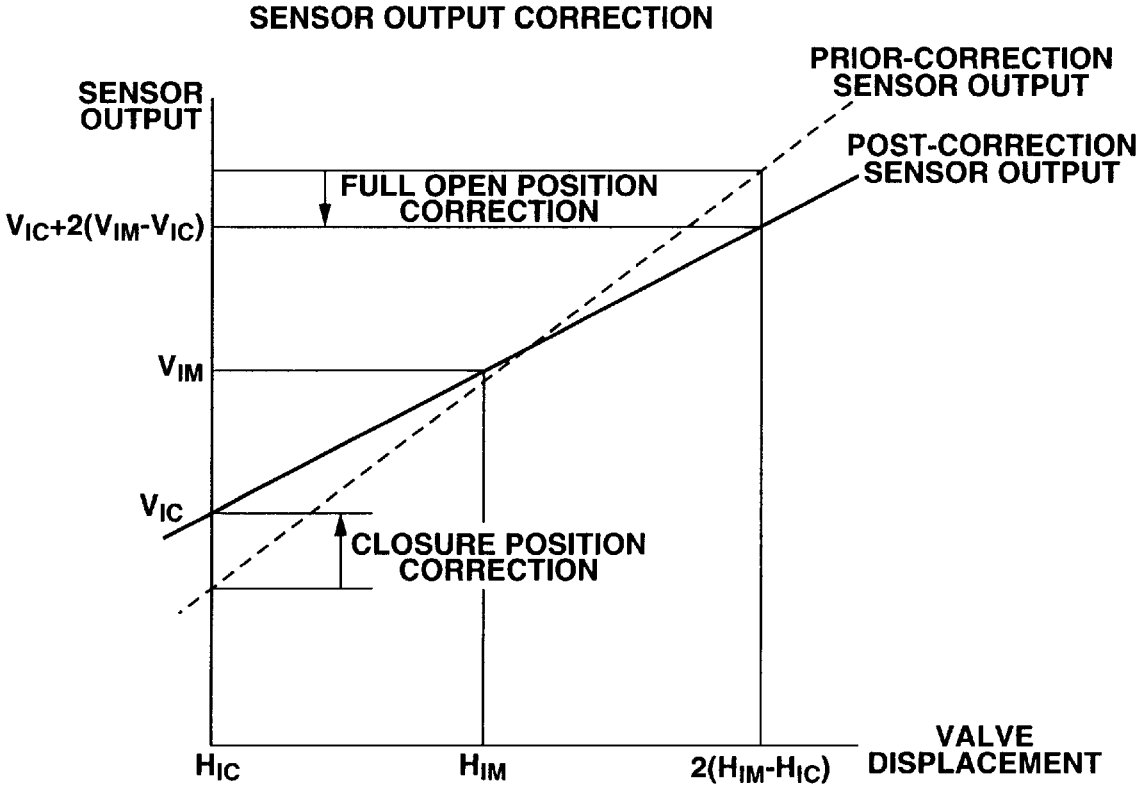
FIG. 10 is a characteristic graph representing the pattern of the correction of the detected value of the position sensor for the intake valve carried out in the third embodiment of the electromagnetically operated engine valve position controlling apparatus according to the present invention.

For intake valve 3, the correction of the detected value of position sensor 55' is carried out on the basis of the output value $V_{IM}$ of position sensor 55' at the neutral position (or called, the initial position) $H_{IM}$ before the initialization and the output value $V_{IC}$ thereof at the closure position $H_{IC}$ thereof upon the completion of initialization, as appreciated from FIG. 10.

Figure 11:
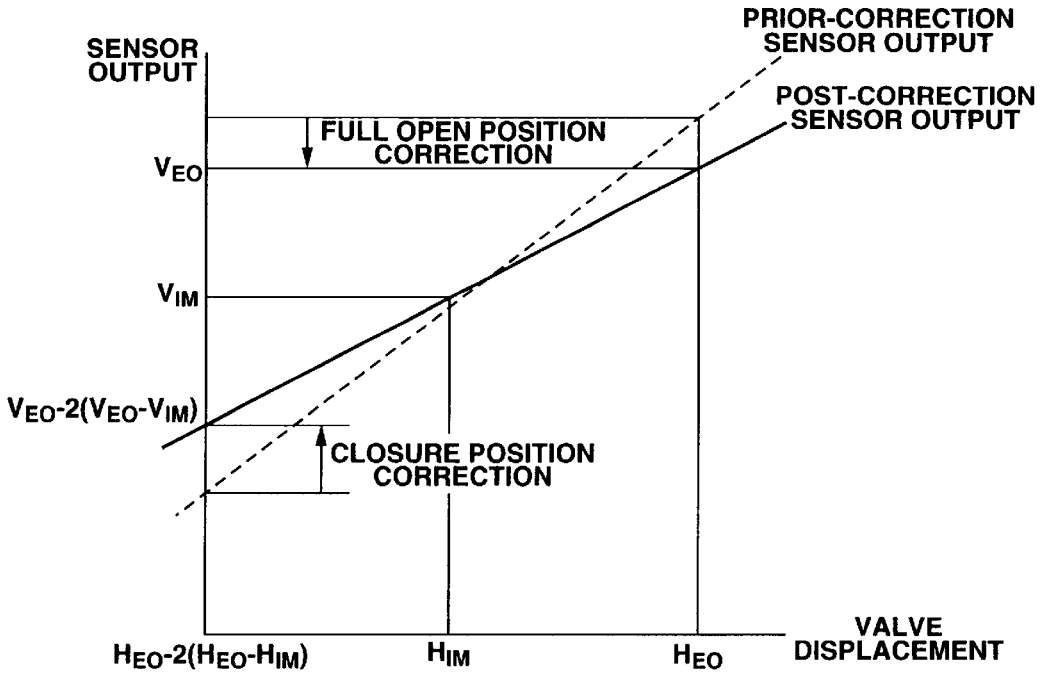
FIG. 11 is a characteristic graph representing the pattern of the correction of the detected value of the position sensor for the exhaust valve carried out in the third embodiment of the electromagnetically operated engine valve position controlling apparatus according to the present invention.

The correction of the detected value of position sensor 55 for exhaust valve 4 is carried out on the basis of the output value $V_{EM}$ of position sensor 55 at the neutral position of exhaust valve 4 before the initialization and the output value $V_{EO}$ of position sensor 55 at the full open position $H_{EO}$ of exhaust valve 4 upon the completion of initialization, as shown in FIG. 11.

Specifically, such a correction as connecting the output value $V_{IM}$ of position sensor 55' at the neutral (initial) position $H_{IM}$ of intake valve 3 to the output value $V_{IC}$ of position sensor 55' at the closure position of intake valve 3 by the straight line is carried out using a linear interpolation to estimate that the output value which corresponds to $2(H_{IM}-H_{IC})$ equivalent to the full open position as $[V_{IC}+2(V_{IM}-V_{IC})]$.

In the same way, such a correction as connecting the output value $V_{IM}$ of position sensor 55' at the neutral position $H_{IM}$ of intake valve 3 to the output value $V_{IC}$ of position sensor 55' at the closure position of intake valve 3 by the straight line segment is carried out using the liner interpolation to estimate that the output value which corresponds to $2[(H_{IM}-H_{IC})]$ (refer to FIG. 10).

On the other hand, in the same manner as described above such a correction as connecting the output value $V_{EM}$ of position sensor 55 at the neutral position $H_{EM}$ of exhaust valve 4 to the output value $V_{EO}$ of the full open position $H_{EO}$ by the straight line segment is carried out so that the output value corresponding to $H_{EO}-2(H_{EO}-H_{IM})$ equivalent to the closure position is estimated as $[V_{EO}2(H_{EO}-H_{IM})]$ (refer to FIG. 11).

In the same way as described in the first embodiment, a simple connection using the output value of position sensor 55 at the normal initialization setting can be made. The simple correction is carried out using the output value of position sensor 55 at the normal initialization setting in the same way as described in the first embodiment. The accuracy of correction can be improved using two output values of the same position sensors 55 and 55' in the same valve. However, since for the output value of position sensor 55 (55') at the open-and-closure position different from that upon the completion of initialization the estimated value is used, the accuracy of correction may slightly be reduced.

It is noted that the same correction of the detected value of position sensor 55 (55') may be executed on the basis of the open-and-closure positions of intake valve 3 and exhaust value 4 which may be set to be reversed as described above.

(Fourth Embodiment)

Next, the correction of the detected value of the position sensor 55 (55') carried out in a fourth preferred embodiment of the electromagnetically operated engine valve position controlling apparatus according to the present invention will be described below.

In the fourth embodiment, for intake valve 3 and exhaust valve 4, the engine valve is temporarily held at the open-and-closure position which is different from that upon the completion of initialization and the output value of position sensor 55 (55') is stored in a memory such as the RAM.

Then, the correction of the detected value of position sensor 55 (55') is carried out on the basis of the output value of position sensor 55 (55') upon the completion of initialization carried out before the engine start and the output value thereof stored during the previous engine stop.

Figure 12:
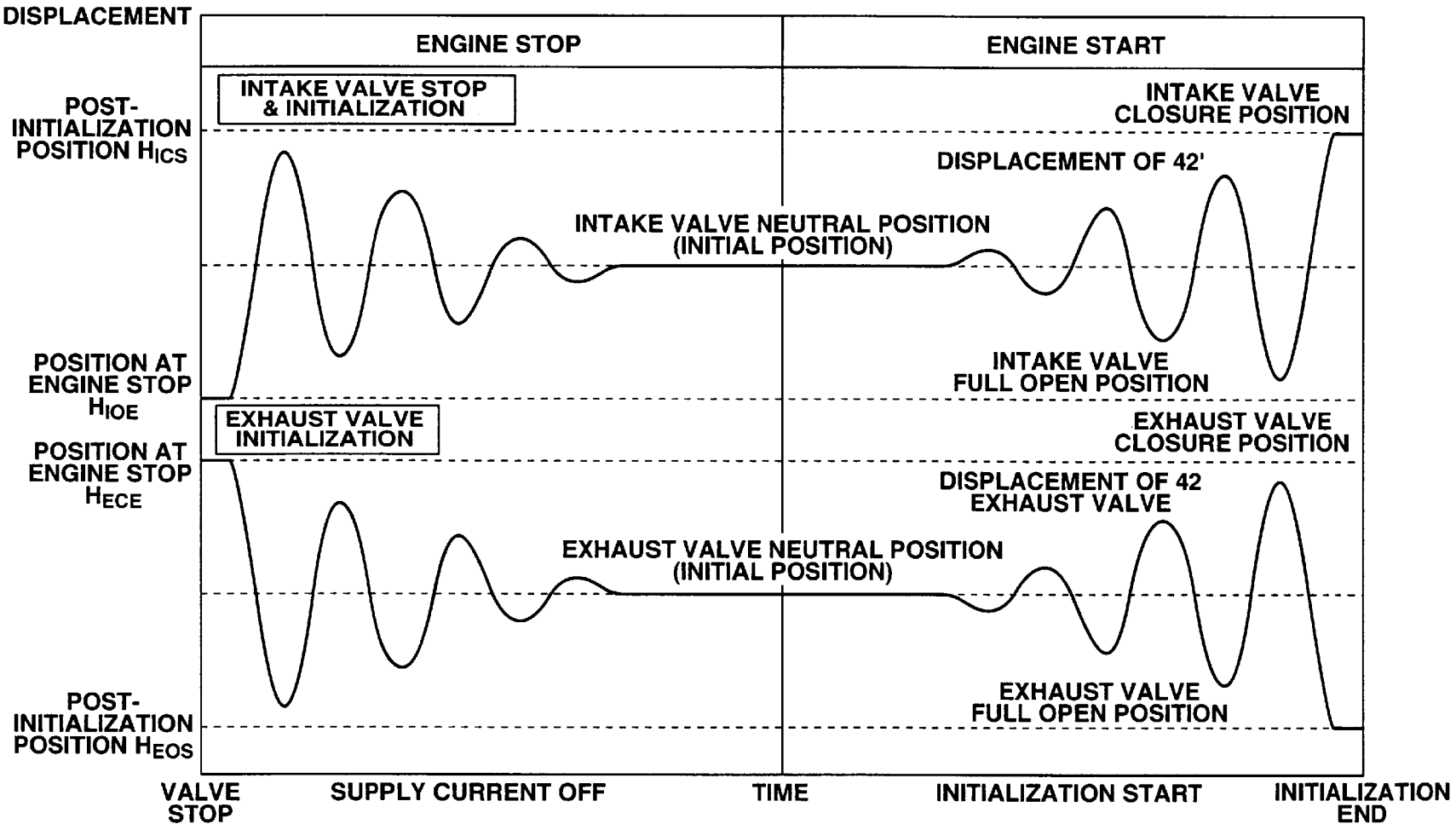
FIG. 12 is a timing chart representing patterns of armature displacements of the intake and exhaust valves when the engine stops and when the intake and exhaust valves are initialized at the open-and-closure positions which are different from those when the engine stops applicable to a fourth preferred embodiment of the electromagnetically operated engine valve position controlling apparatus according to the present invention.

FIG. 12 shows the pattern of initializations for the intake and exhaust valves 3 and 4 which have temporarily been held during the engine stop applicable to the fourth embodiment of the electromagnetically operated engine valve position controlling apparatus.

The other structure of the electromagnetically operated engine valve position controlling apparatus in the fourth embodiment is generally the same as described in the first embodiment.

That is to say, the intake valve 3 is temporarily held at the full open position $H_{IOS}$ during the engine stop. Upon the completion of initialization, intake valve 3 is held at the closure position $H_{ICS}$ and exhaust valve 4 is held at the full open position $H_{EOS}$.

Figure 13:
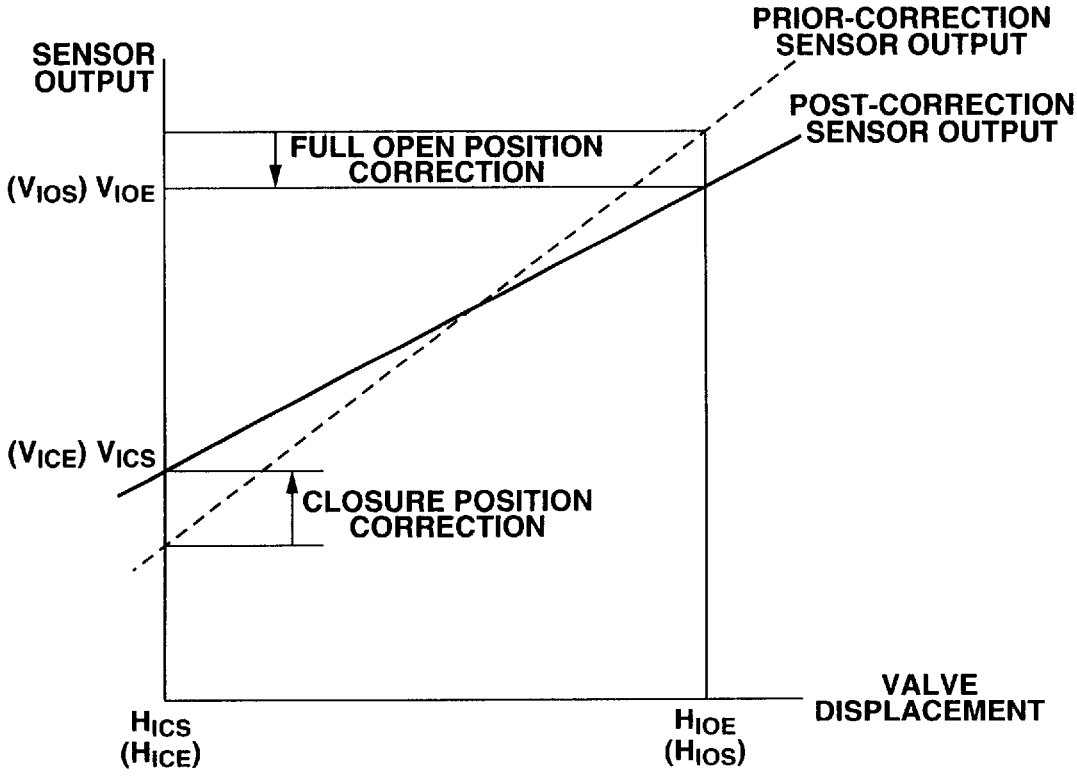
FIG. 13 is a characteristic graph representing the pattern of the correction of the detected value of the position sensor for the intake valve described in the fourth preferred embodiment.

For intake valve 3, the correction of the detected value of position sensor 55' is carried out on the basis of the output value $V_{IOE}$ of the temporarily held full open position $H_{IOE}$ during the engine stop and the output value $V_{ECE}$ of the closure position $H_{ECE}$ upon the completion of initialization as shown in FIG. 13.

Figure 14:
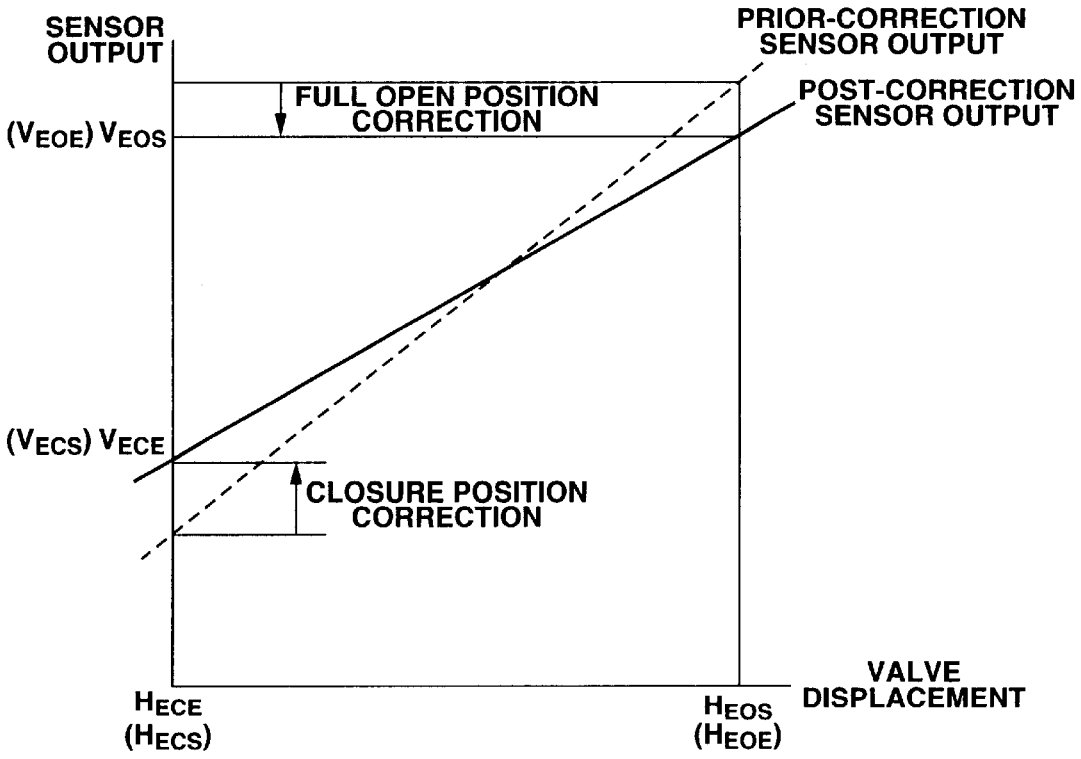
FIG. 14 is a characteristic graph representing the pattern of the correction of the detected value of the position sensor for the exhaust valve described in the fourth preferred embodiment.

For exhaust valve 4, the correction of the detected value of position sensor 55 is carried out on the basis of the output value $V_{ECE}$ of position sensor 55 at the temporarily held closure position $H_{ECE}$ of exhaust valve 4 during the engine stop and the output value $V_{EOS}$ of the full open position upon the completion of the initialization as shown in FIG. 14.

The correction of the detected value of position sensor 55 (55') with a high accuracy can be achieved using the output values of the same position sensor 55 (55') which correspond to that when the same engine valve is displaced at the full open position and which corresponds to that when the same engine valve is displaced at the closure position.

It is noted that the same correction of the detected value of position sensor 55 (55') can be executed when the open-and-closure position of the same engine valve after the initialization may be reversed to that during the engine stop and vice versa.

That is to say, in a case where intake valve 3 is temporarily held at the closure position during the engine stop and held at the full open position upon the completion of the initialization and exhaust valve 4 is temporarily held at the full open position during the engine stop and held at the closure position, the correction of the detected value of position sensor 55' for intake valve 3 is replaced as denoted by contents of respective brackets shown in FIG. 13 ($V_{IOE} \rightarrow V_{IOS}$, $V_{ICS} \rightarrow V_{ICE}$, $H_{ICS} \rightarrow H_{ICE}$, and $H_{IOE} \rightarrow H_{IOS}$).

The correction of the detected value of the position sensor 55 for exhaust valve 4 is replaced as denoted by contents of respective brackets shown in FIG. 14 ($V_{EOS} \rightarrow V_{EOE}$, $V_{ECE} \rightarrow V_{ECS}$, $H_{EOE} \rightarrow H_{EOE}$).

However, a temperature difference generally occurs during the engine stop and during the start. If the temperature difference occurs, the output value of position sensor 55 (55') is varied.

(Fifth Embodiment)

In a fifth preferred embodiment of the electromagnetically operated engine valve position controlling apparatus, the correction of the detected value of position sensor 55 (55') is carried out on the basis of the temperature difference between the engine stop and the engine start as well as those described in the fourth embodiment. The other structure of the electromagnetically operated engine valve is generally the same as described in the first embodiment.

In the fifth embodiment, in the same way as described in the fourth embodiment, intake valve 3 is temporarily held at the full open position $H_{IOE}$ during the engine stop and exhaust valve 4 is held at the closure position $H_{ECS}$ during the engine stop. Upon the completion of the initialization, intake valve 3 is held at the closure position $H_{ICS}$ and exhaust valve 4 is held at the full open position $H_{EOS}$.

With the coolant temperature TwE detected by means of a coolant temperature sensor 11 during the engine stop stored in the memory, the temperature difference ΔTw (=TwS−TwE) from the coolant temperature TwS detected during the engine start to that TwE stored in the memory is calculated.

The output value $V_{IOE}$ of position sensor 55' corresponding to the full open position $H_{IOE}$ of intake valve 3 during the engine stop is corrected with a correction $\Delta V_{IOS}$ corresponding to the temperature difference ΔTw. The correction of the output value $V_{ECE}$ corresponding to the closure position $H_{ECE}$ of exhaust valve 4 during the engine stop is corrected with a correction coefficient $\Delta V_{ECS}$ which accords with the temperature difference ΔTw so that the output value $V_{ECE}$ of position sensor 55 is corrected on the basis of the corrected output value of ($V_{ECS}-\Delta V_{ECS}$) and the full open position $H_{EOS}$ of exhaust valve 4 upon the completion of initialization during the engine start as shown in FIG. 16.

Furthermore, as described above, the relationship between the output signal value of position sensor 55 (55') and the detected value of armature position 42 (42') is corrected after the output value correction corresponding to the temperature difference is made. Hence, the highly accurate correction of the detected value of the armature can be achieved.

Figure 15:
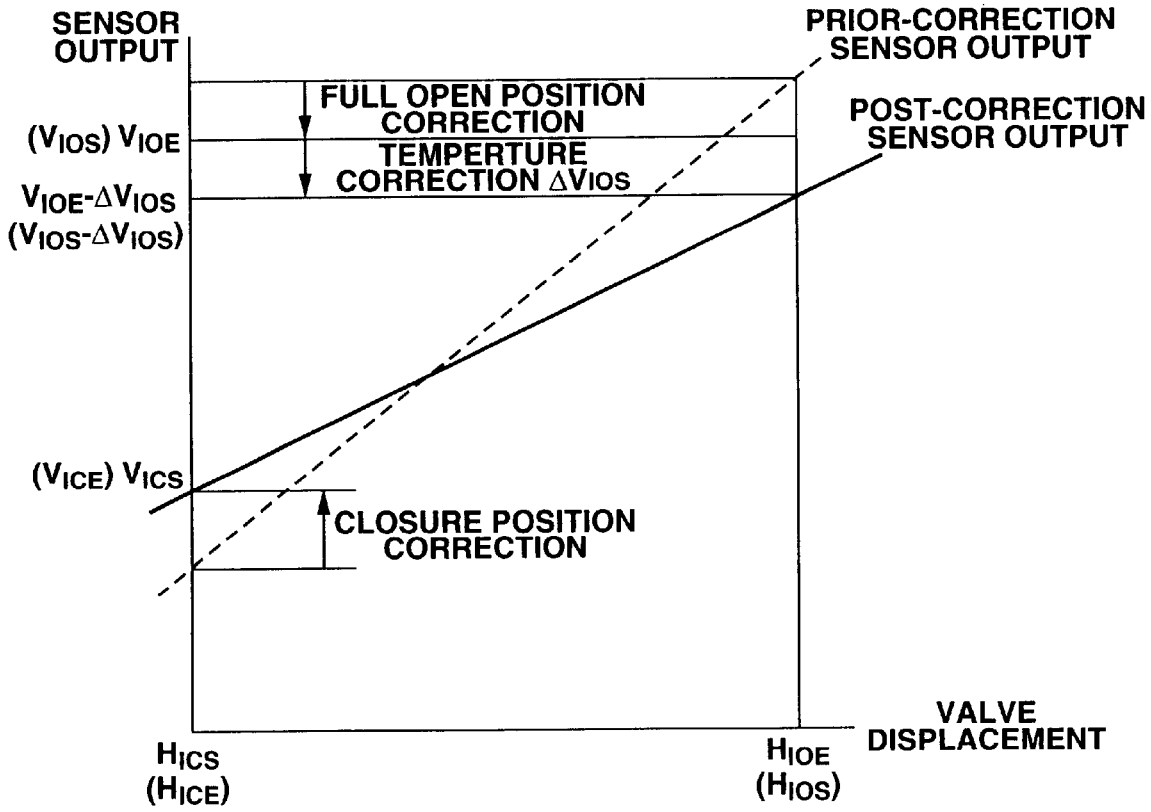
FIG. 15 is a characteristic graph representing the pattern of the correction of the detected value of the position sensor for the intake valve carried out in a fifth preferred embodiment of the electromagnetically operated engine valve position controlling apparatus.
Figure 16:
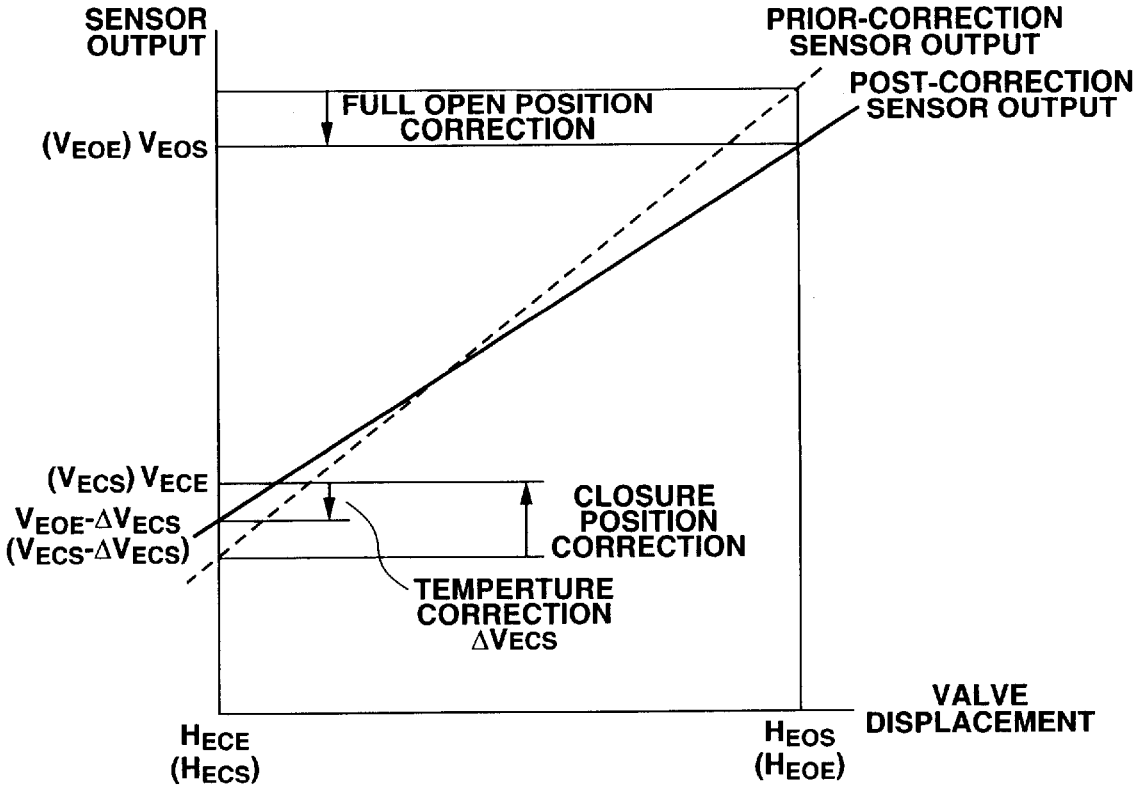
FIG. 16 is a characteristic graph representing the pattern of the correction of the detected value of the position sensor for the exhaust valve carried out in the fifth preferred embodiment of the electromagnetically operated engine valve position controlling apparatus according to the present invention.

It is noted that the contents of the brackets shown in FIGS. 13 and 14 for the reversed case to FIG. 12 described in the fourth embodiment apply equally well to those shown in FIGS. 15 and 16 described in the fifth embodiment.

It is also noted that, as denoted by a dot-and-dash line of FIG. 1A, a lubricating oil temperature sensor 17 may be disposed in housing 41' of intake valve drive unit 2' so that the temperature difference based correction described in the fifth embodiment may be carried out using the lubricating oil temperature placed in the vicinity to the valve body sliding portion of the intake and exhaust valves detected with lubricating oil temperature sensor 17. A highly accurate temperature difference based correction can be made.

It is also noted that the correction of the detected value of position sensor (55 (55')) for the engine valve is carried out immediately after the initialization for the engine valve is carried out.

The entire contents of Japanese Patent Application No. 2000-013223 filed in Japan on Jan. 21, 2000 are herein incorporated by reference. Although the invention has been described above by reference to certain embodiment of the invention, the invention is not limited to the embodiments described above. Modifications and variations of the embodiments described above will occur to those skilled in the art in the light of the above teachings. The scope of the invention is defined with reference to the following claims.

What is claimed is:

1. A control apparatus for an internal combustion engine, comprising:

an armature that is associated with an engine valve;

a spring to bias the armature at a neutral position which is located at an intermediate position between an open position of the engine valve and a closure position thereof;

a first electromagnet to attract the armature toward the open position;

a second electromagnet to attract the armature toward the closure position;

a position sensor to detect a position of the armature and output a signal indicative of the position of the armature; and a controller that controls the first and second electromagnets responsive to the output signal of the position sensor so that the engine valve is displaced between the open position and the closure position and that corrects the output signal of the position sensor on the basis of two output signals of the position sensor which correspond to two different positions of the engine valve, one of the two different positions being one of the open position and the closure position upon a completion of an initialization prior to an engine start.

2. A control apparatus for an internal combustion engine as claimed in claim 1, wherein the engine valve comprises an intake valve and an exhaust valve, the position sensor is disposed on each of the intake and exhaust valves, and the controller holds the intake valve at one of the open position and the closure position which is different from one of those at which the exhaust valve is held upon a completion of the initialization and corrects the output signal of the position sensor to the detected value of the position sensor on the basis of the two output signals of the position sensor which corresponds to the open position of the intake valve upon the completion of the initialization and corresponds to the closure position of the exhaust valve thereupon.

3. A control apparatus for an internal combustion engine as claimed in claim 1, wherein the engine valve comprises an intake valve and an exhaust valve, the position sensor is disposed on each of the intake and exhaust valves, and the controller holds the intake valve at one of the open position and the closure position which is different from one of those at which the exhaust valve is held upon a completion of the initialization and corrects the output signal of the position sensor on the basis of the two output signals of the position sensor which corresponds to the open position of the exhaust valve upon the completion of the initialization and corresponds to the closure position of the intake valve thereupon.

4. A control apparatus for an internal combustion engine as claimed in claim 1, wherein the engine valve comprises an intake valve and an exhaust valve, the position sensor is disposed on each of the intake and exhaust valves, and the controller holds the intake valve at one of the open position and the closure position which is different from one of those at which the exhaust valve is held upon a completion of the initialization corrects the output signal of the position sensor for the intake valve on the basis of the two output signals of the position sensor which corresponds to the open position of the intake valve upon the completion of the initialization and corresponds to the closure position of the exhaust valve thereupon and corrects the output signal of the position sensor for the exhaust valve on the basis of the two output signals of the position sensor which corresponds to the open position of the intake valve upon the completion of the initialization and corresponds to the closure position of the exhaust valve thereupon.

5. A control apparatus for an internal combustion engine as claimed in claim 1, wherein the engine valve comprises an intake valve and an exhaust valve, the position sensor is disposed on each of the intake and exhaust valves, and the controller holds the intake valve at one of the open position and the closure position which is different from one of those at which the exhaust valve is held upon a completion of the initialization corrects the output signal of the position sensor for the intake valve on the basis of the two output signal values of the position sensor which correspond to the open position of the exhaust valve upon the completion of the initialization and correspond to the closure position of the intake valve thereupon and corrects the output signal of the position sensor for the exhaust valve on the basis of the two output signals of the position sensor which correspond to the open position of the exhaust valve upon the completion of the initialization and correspond to the closure position of the intake valve thereupon.

6. A control apparatus for an internal combustion engine as claimed in claim 1, wherein the engine valve comprises an intake valve, the position sensor is disposed on the intake valve for each cylinder of the engine, and the controller that holds the intake valve for one of the cylinders at one of the open and closure positions which is different from one of those at which the intake valve for another of the cylinders is held upon a completion of the initialization and corrects the output signal of the position sensor on the basis of the two output signals of the position sensor which correspond to the open position of the intake valve of the one cylinder upon the completion of the initialization and correspond to the closure position of the intake valve of the other cylinder thereupon.

7. A control apparatus for an internal combustion engine as claimed in claim 1, wherein the engine valve comprises an exhaust valve, the position sensor is disposed on the exhaust valve for each cylinder of the engine, and the controller holds the exhaust valve for one of the cylinders at one of the full open and closure positions which is different from one of those at which the exhaust valve for another of the cylinders is held upon a completion of the initialization and corrects the output signal of the position sensor on the basis of the two output signals of the position sensor which correspond to the open position of the exhaust valve of the one cylinder upon the completion of the initialization and correspond to the closure position of the exhaust valve of the other cylinder thereupon.

8. A control apparatus for an internal combustion engine as claimed in claim 1, wherein the controller corrects the output signal of the position sensor on the basis of the two output signals of the position sensor which correspond to the neutral position of the engine valve prior to the initialization and correspond to one of the open and closure positions of the engine valve upon a completion of the initialization.

9. A control apparatus for an internal combustion engine as claimed in claim 8, wherein the engine valve comprises one of an intake valve and an exhaust valve.

10. A control apparatus for an internal combustion engine as claimed in claim 1, wherein the controller corrects the output signal of the position sensor on the basis of the two output signals of the position sensor which correspond to the neutral position of the engine valve prior to the initialization and correspond to the closure position of the engine valve upon the completion of the initialization.

11. A control apparatus for an internal combustion engine as claimed in claim 1, wherein the controller corrects the output signal of the position sensor on the basis of output values of the position sensor which correspond to the neutral position of the engine valve prior to the initialization and correspond to the full open position of the engine valve upon a completion of the initialization.

12. A control apparatus for an internal combustion engine as claimed in claim 1, wherein the controller comprises to temporarily hold the engine valve at one of the open position and closure position when the engine stops which is different from one of those at which the engine valve is held upon a completion of the initialization, to store the output signal of the position sensor when the controller temporarily holds the engine valve at the one position into a memory and to correct the output signal of the position sensor on the basis of the stored output signal value of the position sensor and the output signal value of the position sensor upon the completion of the initialization.

13. A control apparatus for an internal combustion engine as claimed in claim 12, wherein the engine valve comprises one of an intake valve and an exhaust valve.

14. A control apparatus for an internal combustion engine as claimed in claim 12, further comprising a temperature sensor to detect a temperature around the position sensor and the controller comprises to correct the output signal of the position sensor in accordance with a temperature difference between detected values of the temperature sensor when the engine stops and when the engine starts and, thereafter, to correct the output signal of the position sensor.

15. A control apparatus for an internal combustion engine as claimed in claim 14, wherein the temperature sensor comprises an engine coolant temperature sensor.

16. A control apparatus for an internal combustion engine as claimed in claim 14, wherein the temperature sensor comprises an engine lubricating oil temperature sensor located near to the armature.

17. A control apparatus for an internal combustion engine as claimed in claim 13, wherein the controller comprises to correct the output signal of the position sensor through a linear interpolation for a table representing the relationship of the output signal of the position sensor to a valve displacement of the engine valve between the closure position to the open position using the two output signals of the position sensor.

18. A control apparatus for an internal combustion engine as claimed in claim 1, wherein the controller comprises to perform the initialization prior to the engine start such as to repeat the turn on-and-off of the power supply to each of the first and second electromagnets in an alternating manner at a predetermined frequency to develop a resonance in the engine valve together with an action of the spring and to hold the engine valve at one of the open position and closure position upon a completion of the initialization.

19. A control apparatus for an internal combustion engine as claimed in claim 1, wherein the position sensor is attached onto a valve housing of the engine valve to face against the armature via the spring to magnetically detect the position of the armature, the armature being enabled to move within the engine valve housing between the first and second electromagnets so that the engine valve is displaced between the open position and closure position, the open position corresponding to one of two positions of the armature attracted toward and held at a position of the first electromagnet when energized with the second electromagnet de-energized and the closure position corresponding to the other position of the armature attracted toward and held at a position of the second electromagnet when energized with the first electromagnet de-energized.

20. A control method for an internal combustion engine, the internal combustion engine comprising:

a spring to bias an engine valve at a neutral position which is located at an intermediate position between a full open position of the engine valve and a closure position thereof;

a first electromagnet to attract the engine valve toward the full open position and hold the engine valve thereat when energized; a second electromagnet to attract the engine valve toward the closure position and hold the engine valve thereat when energized; and a position sensor to detect a position of an armature which is common to each of the first and second electromagnets and is associated with a valve body of the engine valve and output a signal indicative of the position of the armature and the control method comprising:

executing an initialization prior to an engine start for the engine valve;

correcting a relationship of an output signal value of the position sensor to a detected value of the position of the armature on the basis of two output signal values of the position sensor which corresponds to two different positions of the engine valve, one of the two different positions being one of the full open position and the closure position after executing the initialization; and being responsive to the output signal of the position sensor to control a turn on-and-off of a power supply to each of the first and second electromagnets so that the engine valve is displaced between the full open position and the closure position.

* * * * *